US010859075B2

(12) United States Patent
Bredbeck et al.

(10) Patent No.: US 10,859,075 B2
(45) Date of Patent: Dec. 8, 2020

(54) DOUBLE-PISTON COMPRESSOR OF A COMPRESSED-AIR SUPPLY DEVICE

(71) Applicant: WABCO GmbH, Hannover (DE)

(72) Inventors: Klaus Bredbeck, Landesbergen (DE); Dieter Frank, Hannover (DE); Thorsten Weber, Wunstorf (DE)

(73) Assignee: WABCO GMBH, Hannover (DE)

( * ) Notice: Subject to any disclaimer, the term of this patent is extended or adjusted under 35 U.S.C. 154(b) by 324 days.

(21) Appl. No.: 15/763,841

(22) PCT Filed: Dec. 7, 2016

(86) PCT No.: PCT/EP2016/002060

§ 371 (c)(1),
(2) Date: Mar. 28, 2018

(87) PCT Pub. No.: WO2017/097415

PCT Pub. Date: Jun. 15, 2017

(65) Prior Publication Data

US 2018/0266406 A1 Sep. 20, 2018

(30) Foreign Application Priority Data

Dec. 8, 2015 (DE) ..... 10 2015 015 948
Nov. 17, 2016 (DE) ..... 10 2016 013 739

(51) Int. Cl.
*F04B 35/01* (2006.01)
*F04B 27/02* (2006.01)
(Continued)

(52) U.S. Cl.
CPC ..... *F04B 35/01* (2013.01); *F04B 5/02* (2013.01); *F04B 9/045* (2013.01); *F04B 27/005* (2013.01); *F04B 27/02* (2013.01)

(58) Field of Classification Search
CPC ..... F04B 27/005; F04B 27/02; F04B 1/02; F04B 5/00; F04B 5/02; F04B 9/045; F04B 35/01; F04B 9/047; F16J 1/14
See application file for complete search history.

(56) References Cited

U.S. PATENT DOCUMENTS 1,868,498 A * 7/1932 Gruman ..... F04B 1/02 417/288
4,078,439 A * 3/1978 Iturriaga-Notario .... F04B 27/02 123/197.1

(Continued)

FOREIGN PATENT DOCUMENTS

DE 918042 C 9/1954
DE 19715291 A1 10/1998

(Continued)

*Primary Examiner* — Bryan M Lettman
(74) *Attorney, Agent, or Firm* — Leydig, Voit & Mayer, Ltd.

(57) ABSTRACT

A double-piston compressor of a compressed air supply device includes a first pressure stage and a second pressure stage, each having a cylinder with a piston guided therein in an axially movable manner. The piston of the cylinder of the first pressure stage and the cylinder of the second pressure stage are rigidly connected to one another via a piston rod and are in driving connection with the drive shaft via a slotted guide. The slotted guide comprises a recess which is formed in the piston rod, provided with a slotted guide track and oriented perpendicularly to an axis of rotation of the drive shaft with its cross-sectional plane. The slotted guide comprises a drive roller which is engaged with the recess and fastened to the drive shaft in an axially parallel, eccentric, and also rotatable manner with respect to the axis of rotation of the drive shaft.

27 Claims, 24 Drawing Sheets

(51) Int. Cl.

| | |
|---|---|
| ***F04B 9/04*** | (2006.01) |
| ***F04B 5/02*** | (2006.01) |
| ***F04B 27/00*** | (2006.01) |

(56) References Cited

U.S. PATENT DOCUMENTS

| | | | | |
|---|---|---|---|---|
| 4,097,203 | A * | 6/1978 | Selwood | F04B 9/045 417/480 |
| 4,753,118 | A * | 6/1988 | Siller | F04B 9/045 74/25 |
| 5,004,404 | A * | 4/1991 | Pierrat | F01B 9/026 417/273 |
| 5,030,065 | A | 7/1991 | Baumann | |
| 5,114,321 | A * | 5/1992 | Milburn | F04B 19/02 417/467 |
| 6,283,723 | B1 * | 9/2001 | Milburn | F04B 27/005 417/273 |
| 7,878,081 | B2 * | 2/2011 | Sundheim | F04B 27/005 74/50 |
| 2004/0228737 | A1 | 11/2004 | Folchert | |
| 2005/0238513 | A1 * | 10/2005 | Mueller | F04B 27/02 417/437 |
| 2011/0079036 | A1 | 4/2011 | Chang | |
| 2011/0277626 | A1 * | 11/2011 | Asai | F04B 39/0005 92/249 |
| 2012/0020821 | A1 * | 1/2012 | Asai | F04B 39/0005 417/437 |
| 2012/0177524 | A1 * | 7/2012 | Komatsu | F01B 1/062 418/161 |
| 2015/0209986 | A1 * | 7/2015 | Sommer | F04B 1/0408 264/279 |
| 2017/0138913 | A1 * | 5/2017 | Nocon | F04B 53/16 |
| 2018/0187664 | A1 * | 7/2018 | Bassine | A61M 16/10 |
| 2018/0266406 | A1 * | 9/2018 | Bredbeck | F04B 27/02 |
| 2018/0283366 | A1 * | 10/2018 | Meissner | F04B 27/0428 |
| 2019/0010937 | A1 * | 1/2019 | Bredbeck | F04B 27/005 |

FOREIGN PATENT DOCUMENTS

| | | | |
|---|---|---|---|
| DE | 10321771 | B4 | 12/2004 |
| DE | 102011086913 | A1 | 11/2012 |
| DE | 102012223114 | A1 | 6/2014 |
| EP | 0389414 | B1 | 6/1993 |
| FR | 2330884 | A1 | 6/1977 |

* cited by examiner

DOUBLE-PISTON COMPRESSOR OF A COMPRESSED-AIR SUPPLY DEVICE

CROSS REFERENCE TO RELATED APPLICATIONS

This application is a U.S. National Stage Application under 35 U.S.C. § 371 of International Application No. PCT/EP2016/002060 filed on Dec. 7, 2016, and claims benefit to German Patent Application Nos. DE 10 2015 015 948.8 filed on Dec. 8, 2015 and DE 10 2016 013 739.8 filed on Nov. 17, 2016. The International Application was published in German on Jun. 15, 2017 as WO 2017/097415 A1 under PCT Article 21(2).

FIELD

The invention relates to a double-piston compressor of a compressed air supply device having a first pressure stage and a second pressure stage.

BACKGROUND

Double-piston compressors comprising two pistons which are rigidly connected to one another via a piston rod and which are guided in an axially movable manner in cylinders arranged radially opposite with respect to the axis of rotation of a drive shaft have been known for some time in embodiments which differ in terms of drive technology.

In a double-piston compressor design known from DE 103 21 771 B4, the piston rod is in driving connection with the drive shaft via a connecting rod. The connecting rod is connected to the drive shaft and the piston rod in an articulated manner firstly via a crank pin which engages with a first bore on the end side and is fastened eccentrically to the drive shaft and secondly via a drive pin which engages with a second bore on the end side and is fastened eccentrically to the piston rod in the longitudinal direction.

Conversely, with a substantially simpler and more space-saving double-piston compressor design, the piston rod is only in driving connection with the drive shaft via a slotted guide. In a known embodiment, the slotted guide comprises a recess which is arranged in the piston rod, provided with two parallel slotted guide tracks, oriented perpendicularly to the axis of rotation of the drive shaft, and also a drive element which is engaged with the recess and fastened to the drive shaft in an axis parallel and eccentric manner with respect to the axis of rotation of the drive shaft.

DE 197 15 291 C2 describes a double-piston compressor with a slotted guide, wherein the recess of the slotted guide has a rectangular design. With a slotted guide of this kind, the side walls of the recess form the parallel slotted guide tracks, and the two parts of the piston rod are connected to one another via the bottom wall of the recess. The drive element in this slotted guide is configured as the outer ring of a roller bearing which is arranged on a crank pin fastened eccentrically to the drive shaft, and the outer ring whereof is guided in a rolling movable manner between the slotted guide tracks of the slotted guide.

On the other hand, a double-piston compressor with a slotted guide is known from DE 10 2012 223 114 A1, wherein the recess of the slotted guide is configured as a slot-shaped through-opening. In this embodiment of the slotted guide, the planar inner walls of the recess form the parallel slotted guide tracks and the two parts of the piston rod are connected to one another via webs at the ends which have a circular arc shape in the present case but which may also be straight in design if there is appropriate spacing. The drive element in this slotted guide is configured as a roller which is mounted in a directly rotatable manner on a crank pin which is fastened eccentrically to the drive shaft and is guided in a rolling-movable manner between the slotted guide tracks of the slotted guide.

Depending on the resulting direction of force of the contact forces acting on the two pistons, the drive element bears against one of the two parallel slotted guide tracks and, when the resulting direction of force is reversed and the clearance inevitably present in the slotted guide is bridged, switches to bearing against the other slotted guide track in each case. With this kind of load change of the drive element between the parallel slotted guide tracks, there is a disadvantageously high local load and corresponding signs of wear in the contact region between the drive element and the slotted guide tracks. In addition, this leads to discontinuity in the stroke pattern of the piston rod or the piston. The other problem here is that of excessive noise generation which is caused by the discontinuity.

In order to avoid these disadvantages, DE 10 2011 086 913 A1 proposes a double-piston compressor with a slotted guide, wherein the parallel slotted guide tracks of the U-shaped recess are staggered in an axially displaced manner radially opposite one another. In this slotted guide, the outer rings of two roller bearings are provided as drive elements which are arranged axially adjacent on a crank pin fastened eccentrically to the drive shaft. The outer rings of the roller bearings should bear against the projecting portion of a slotted guide track in each case in a largely clearance-free reciprocal manner. In order to facilitate elastic pretensioning of the drive elements between the slotted guide tracks in conjunction with an oversize of the outer rings or a reduced spacing of the parallel slotted guide tracks, the raised portions of the slotted guide tracks are preferably made of an elastic material. This slotted guide of the known double-piston compressor involves a higher construction cost and greater space requirement compared with the aforementioned slotted guides.

SUMMARY

In an embodiment, the present invention provides a double-piston compressor of a compressed air supply device. The double-piston compressor includes a first pressure stage and a second pressure stage, each having a cylinder with a piston guided therein in an axially movable manner. The cylinder of the first pressure stage and the cylinder of the second pressure stage are arranged radially opposite one another with respect to an axis of rotation of a drive shaft, wherein the piston of the cylinder of the first pressure stage and the cylinder of the second pressure stage are rigidly connected to one another via a piston rod and are in driving connection with the drive shaft via a slotted guide. The slotted guide comprises a recess which is formed in the piston rod, provided with a slotted guide track and oriented perpendicularly to an axis of rotation of the drive shaft with its cross-sectional plane. The slotted guide comprises a drive roller which is engaged with the recess and fastened to the drive shaft in an axially parallel, eccentric, and also rotatable manner with respect to the axis of rotation of the drive shaft. The recess in the slotted guide is delimited by a closed slotted guide track which is oriented centrally with respect to a central axis of the piston rod and on which the drive roller rolls and is permanently loaded by a resulting contact force on the two pistons. A lateral distance of the slotted guide track, measured perpendicularly to a central axis of the piston rod, corresponds at most to the sum of twice an eccentricity and twice a rolling radius of the drive roller. A stroke distance of the slotted guide track, measured parallel to the central axis of the piston rod, exceeds twice the rolling radius of the drive roller and falls below a sum of twice the eccentricity and twice the rolling radius of the drive roller.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
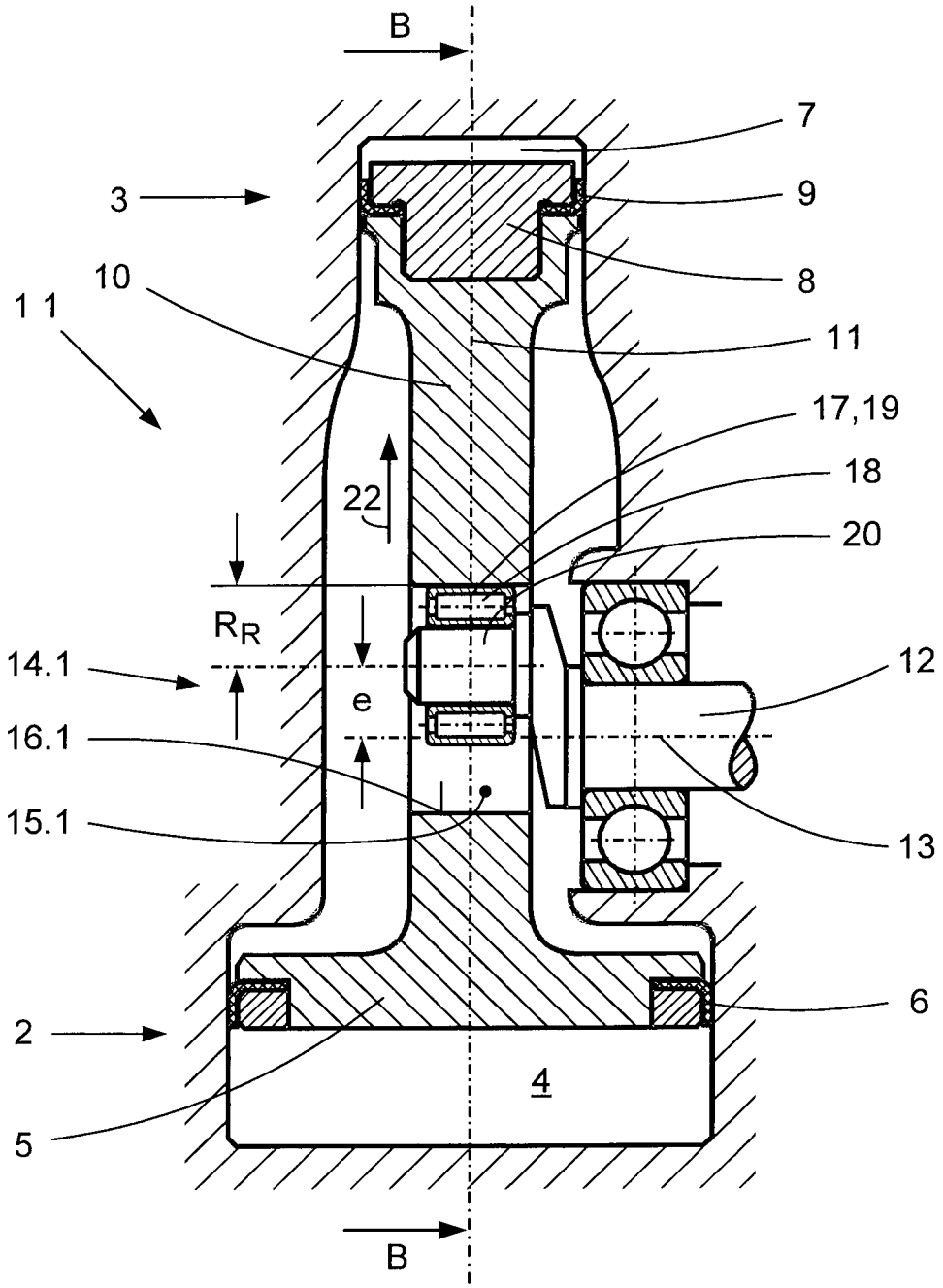
FIG. 1 shows a double-piston compressor according to an embodiment of the invention in a longitudinal central section.

Embodiments of the invention provide double-piston compressors of a compressed air supply device having a first pressure stage and a second pressure stage, each of which has a cylinder with a piston guided therein in an axially movable manner, wherein the two cylinders are arranged radially opposite one another with respect to an axis of rotation of a drive shaft, wherein the two pistons are rigidly connected to one another via a piston rod and are in driving connection with the drive shaft via a slotted guide, wherein the slotted guide comprises a recess which is formed in the piston rod, provided with a slotted guide track and oriented perpendicularly to the axis of rotation of the drive shaft with its cross-sectional plane, and wherein the slotted guide comprises a drive roller which is engaged with the recess and fastened to the drive shaft in an axially parallel, eccentric and also rotatable manner with respect to the axis of rotation of the drive shaft.

Embodiments of the invention present double-piston compressors with the design referred to above, in which the slotted guide is configured in such a manner that without additional components or a greater building space requirement associated therewith, a continuous stroke pattern of the pistons can be guaranteed, wherein discontinuity in the stroke of the pistons and signs of wear due to load change on the drive roller can be avoided.

Embodiments of the invention provide double-piston compressors of a compressed air supply device comprising a first pressure stage, for example a low-pressure stage, and a second pressure stage, for example a high-pressure stage, which each have a cylinder with a piston guided therein in an axially movable manner, wherein the two cylinders are arranged radially opposite one another with respect to an axis of rotation of a drive shaft, wherein the two pistons are rigidly connected to one another via a piston rod and are in driving connection with the drive shaft via a slotted guide, wherein the slotted guide has a recess which is arranged in the piston rod, provided with a slotted guide track and oriented perpendicularly to the axis of rotation of the drive shaft, and wherein the slotted guide has a drive roller which is engaged with the recess and fastened to the drive shaft in an axially parallel, eccentric and also rotatable manner with respect to the axis of rotation of the drive shaft.

Embodiments of the invention further provide a double-piston compressor having a recess in a slotted guide that is delimited by a closed slotted guide track which is oriented centrally with respect to a central axis of the piston rod and on which the drive roller rolls and is permanently loaded by means of a resulting contact force on the two pistons, in such a manner that the lateral distance of the slotted guide track, measured perpendicularly to the central axis of the piston rod, corresponds at most to the sum of twice the eccentricity and twice the rolling radius of the drive roller and that the stroke distance of the slotted guide track, measured parallel to the central axis of the piston rod, exceeds twice the rolling radius of the drive roller and falls below the sum of twice the eccentricity and twice the rolling radius.

The lateral distance in this case refers to the total of the maximum distance between the central axis and the slotted guide track measured perpendicularly to the central axis in each case. The lateral distance may therefore also be greater than the cross section of the recess measured perpendicularly to the central axis at each point, depending on the design of the recess. Rather, the lateral distance is the projection of the maximum diameter of the recess on a plane perpendicular to the central axis.

The stroke distance, on the other hand, in an idealized observation refers to the clear width of the recess along the central axis.

The eccentric arrangement of the drive roller means that a rotation of the drive shaft causes a crank movement of the drive roller which is transformed by the rolling of the drive roller on the closed slotted guide track of the slotted guide into a periodic stroke movement of the piston rod or of the two pistons. In this case, the geometry of the slotted guide track configured as a freeform curve, for example, in conjunction with a contact force acting against the stroke movement on the piston located in the pressure stroke in each case ensures continuous rolling contact of the drive roller with the slotted guide track. Consequently, in the case of the slotted guide according to embodiments of the invention, discontinuity in the stroke path of the pistons and signs of wear associated therewith are automatically avoided by a load change of the drive roller, without there being any need for additional components and, associated with this, a greater space requirement.

In a first preferred embodiment, the lateral distance of the slotted guide track is smaller by an amount Δ than the sum of twice the eccentricity and twice the rolling radius of the drive roller. If the lateral distance of the slotted guide track corresponds exactly to the sum of twice the eccentricity and twice the rolling radius, in other words twice the total of the eccentricity and the rolling radius of the drive roller, the drive roller is continuously in contact with the slotted guide track. If, however, the lateral distance is smaller by an amount Δ, there is an undersize of the slotted guide track with respect to the envelope circle which is created by the movement of the drive roller, so that the drive roller not only exerts a force on the piston rod in the direction of the central axis, but also perpendicularly to the central axis of the piston rod. In this way, tolerances are primarily balanced and a permanent contact between the drive roller and the slotted guide track is guaranteed. The balancing of the axial displacement of the piston rod due to the undersized slotted guide track may, for example, be provided by corresponding seals or a resilient material.

In a preferred embodiment, the amount Δ is within a range of 1% to 5% of the sum of twice the eccentricity and twice the rolling radius of the drive roller. Particularly preferably, the amount Δ lies within a range of 1.5% to 2%.

In order to achieve a continuous stroke path and make production of the slotted guide as simple as possible, the recess in the slotted guide is preferably delimited by a substantially elliptical slotted guide track, the main axis whereof has a length which is at most the sum of twice the eccentricity and twice the rolling radius of the drive roller divided by the cosine of the angle of inclination of the main axis with respect to a perpendicular to the central axis of the piston rod and the secondary axis whereof has a length which falls below the sum of twice the eccentricity and twice the rolling radius of the drive roller, but which is at least large enough for the flanging radii of the elliptical slotted guide track to be greater than the rolling radius of the drive roller.

In a basic design of the slotted guide the main axis H of the elliptical slotted guide track is oriented perpendicularly to the central axis of the piston rod. In this way, a purely sinusoidal stroke movement of the pistons with the same stroke heights in each case in the pressure and intake strokes of both pistons is produced. The length $L_H$ of the main axis H of the elliptical slotted guide track in this case corresponds at most to the sum of twice the eccentricity e and twice the rolling radius $R_R$ of the drive roller ($L_H \leq 2*(e+R_R)$), in order to guarantee contact of the guide roller in the lateral regions of the slotted guide track.

According to a first variant of the slotted guide, the main axis H' of the elliptical guide track is inclined with respect to a perpendicular to the central axis of the piston rod in the direction of rotation of the drive shaft. Through an inclination of the elliptical slotted guide track with respect to the perpendicular to the central axis of the piston rod, the force ratios in the slotted guide can generally be set in a suitable manner. Through an inclination of the slotted guide track in the direction of rotation of the drive shaft, an increase in the stroke height and a phase displacement of the stroke curve in the retarded direction are produced in addition with respect to the stroke curve for a perpendicular orientation of the slotted guide track. Due to the shortening of the projection of the main axis H' to the perpendicular on the central axis of the piston rod, the length $L_H'$ of the main axis H' of the elliptical slotted guide track in this case corresponds at most to the sum of twice the eccentricity e and twice the rolling radius $R_R$ of the drive roller divided by the cosine of the angle of inclination α of the main axis H' with respect to the perpendicular to the central axis of the piston rod ($L_H' \leq 2*(e+R_R)/\cos\alpha$), in order firstly to guarantee the movability of the drive roller in the slotted guide and secondly the contact of the drive roller in the lateral regions of the slotted guide track.

According to a second variant of the slotted guide, the main axis H' of the elliptical slotted guide track of the slotted guide with respect to the perpendicular to the central axis of the piston rod is inclined against the direction of rotation of the drive shaft. Through an inclination of the slotted guide track against the direction of rotation of the drive shaft, an increase in the stroke height is also produced but a phase displacement of the stroke curve in the advanced direction with respect to the stroke curve for a perpendicular orientation of the slotted guide track. In this too the length $L_H'$ of the main axis H' of the elliptical slotted guide track corresponds at most to the sum of twice the eccentricity e and twice the rolling radius $R_R$ of the drive roller divided by the cosine of the angle of inclination α of the main axis H' with respect to the perpendicular to the central axis of the piston rod ($L_H' \leq 2*(e+R_R)/\cos\alpha$), in order to guarantee the movability of the drive roller in the slotted guide and the contact of the drive roller in the lateral regions of the slotted guide track.

For installation-space and functional reasons, the angle of inclination α of the main axis H' of the slotted guide track should be at most 45° with respect to the perpendicular to the central axis of the piston rod. However, angles of inclination of maximum 30° are regarded as advantageous, in order to ensure under all operating conditions that the drive roller is in contact with the slotted guide track.

The elliptical slotted guide track of the slotted guide is usually of symmetrical design with semi-axes of the same length of the secondary axis N. The stroke height $z_{H_max}$ of the pistons in this case is identical in the intake stroke and in the pressure stroke and is obtained from the sum of the eccentricity e and the rolling radius $R_R$ of the drive roller minus half the length $L_N$ of the secondary axis N of the elliptical slotted guide track ($z_{H_max}=e+R_R-L_N/2$).

The elliptical slotted guide track of the slotted guide may, however, also be asymmetrically designed with semi-axes of different lengths of the secondary axis N'. For example, the length $L_N'/2$ of the semi-axis of the secondary axis N' which faces the piston in the high-pressure stage may be shorter compared with the length $L_N/2$ of the other semi-axis ($L_N'/2<L_N/2$), as a result of which the stroke height of the pressure stroke of the piston in the second pressure stage and the stroke height of the intake stroke of the piston in the first pressure stage are greater to the same extent compared with the stroke height in the opposite direction ($z_{H_max}'=e+R_R-L_N'/2>z_{H_max}=e+R_R-L_N/2$).

So that a radial contact force of the drive roller on the slotted guide track is also produced in the lateral portions of the slotted guide in which the elliptical slotted guide trace has portions running largely parallel to the central axis of the piston rod, the main axis H, H' of the slotted guide track preferably has a length $L_H$, $L_H'$ which falls slightly below the sum of twice the eccentricity e and twice the rolling radius $R_R$ of the drive roller divided by the cosine of the angle of inclination $\alpha$ of the main axis H, H' with respect to the perpendiculars to the central axis of the piston rod ($L_H<2*(e+R_R)/\cos\Delta[\cos\Delta=0]$; $L_H'<2*(e+R_R)/\cos\alpha$).

In this case, the two pistons are preferably guided in the cylinders via a sealing ring in each case, said sealing rings preferably being formed from sealing collars made of a spring-elastic material. In this way, the radial contact force of the drive roller produced by the undersize of the main axis H, H' of the elliptical slotted guide track in conjunction with a small radial displacement of the piston rod is elastically supported by the sealing collars. The sealing rings or sealing collars preferably allow a movement of the piston perpendicularly to the central axis.

In addition to this, the radial contact force of the drive roller may also be elastically supported in that the radially inner face of the recess is lined with a spring-elastic layer which then forms the slotted guide track of the slotted guide in this case. Alternatively or in addition, the outer wall of the drive roller is lined with a spring-elastic layer. As an alternative to the sealing collar design, the sealing rings of the pistons in this case may also be formed from piston rings made of a metal.

The spring-elastic layer of the slotted guide track of the slotted guide and/or of the outer wall of the drive roller is preferably made of rubber. In addition to the elastic support of the radial contact force of the drive roller, the adhesive friction between the drive roller of the slotted guide track can also advantageously be increased by the rubber layer and a sliding movement of the drive roller therefore avoided.

In order to reduce the peak loading of the slotted guide track, at least one central portion of the slotted guide track of the slotted guide may be designed to be capable of buckling automatically in a load-dependent manner. Due to the buckling of the center portion of the slotted guide track which is possible as a result, the stroke height of the pressure stroke of the facing piston is lowered in a force-dependent manner and the mechanical peak load of the slotted guide is thereby reduced.

For this purpose it is provided, for example, that the wall of the at least one central portion of the slotted guide track is of spring-elastic design and also spans a cavity in the piston rod, in which the wall of the central portion of the slotted guide track which buckles under high loads is received.

As an alternative to this, the wall of the at least one central portion of the slotted guide track may also be configured in a bending-elastic manner and also span a cavity in the piston rod, in which at least one pressure spring in contact with the respective wall is arranged, and in which the wall of the central portion of the slotted guide track which buckles under high loads is received.

In relation to the contour of the elliptical slotted guide track and the outer wall of the drive roller in contact therewith, it is preferably provided that the slotted guide track of the slotted guide is of planar design in the longitudinal profile and that the drive roller has a cylindrical outer wall with which the drive roller rolls on the slotted guide track. Due to these planar contours on the slotted guide track and the drive roller in the axial direction of the drive shaft, a rotational guide of the piston rod is produced which means that anti-twist protection of the pistons is unnecessary. In addition, an axial displacement of the drive roller with respect to the slotted guide track is thereby possible, so that axial displacements of the drive shaft or of the drive roller caused by production tolerances and thermal expansion can be balanced in a non-distorted manner.

In order to ensure a continuous rolling contact of the drive roller with the slotted guide track without the previously mentioned measures for producing a lateral radial contact force of the drive roller, it may be provided that the slotted guide track of the slotted guide is provided with circumferential inner toothing and that the drive roller has on its outer wall outer toothing with the same tooth pitch, via the pitch circle whereof the drive roller rolls on the pitch circle of the inner toothing of the slotted guide track. The expenditure involved in producing the toothing is relatively high, however. Also with this slotted guide design, a rotational guide of the piston rod is produced and an axial displacement of the drive roller with respect to the slotted guide track is made possible.

If, however, an axial guide of the drive roller and the drive shaft connected thereto is desired, this can be achieved in that the slotted guide track of the slotted guide is provided with a circumferential inner web and that the drive roller has in its outer wall a circumferential annular groove with which the inner web of the slotted guide track engages for the axial guiding of the drive roller.

In a first drive roller design, the drive roller is arranged rotatably via a rolling bearing or a slide bearing on a bearing bolt which is fastened eccentrically to the drive shaft. In order to achieve a compact design, the drive roller in this design is preferably formed by an outer ring of the rolling bearing or by a bushing of the slide bearing.

In a second drive roller design, the drive roller is configured as a cylindrical plate and rigidly connected to a central bearing bolt which is rotatably mounted via a rolling bearing or a slide bearing in a bearing bore arranged eccentrically on the drive shaft.

For improved mounting of the drive roller and of the drive shaft, it may be provided in addition that the bearing bolt of the drive roller or the drive roller itself is provided with a central outer bearing shaft which is radially externally supported via a rolling bearing or a slide bearing on a bearing pin oriented coaxially to the axis of rotation of the drive shaft and fastened at the housing end.

In the figures, sectional planes are indicated by the reference numbers A, B, C, D, E, F, K, L.

Figure 1A:
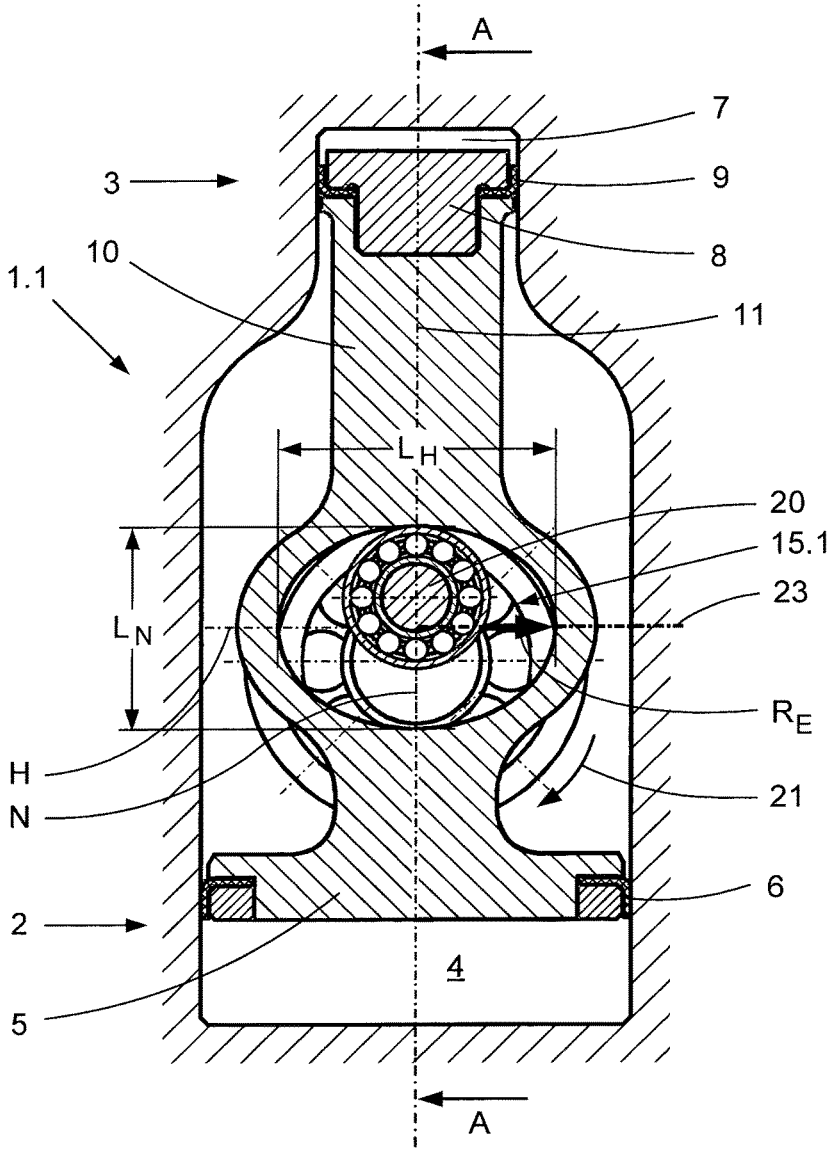
FIG. 1*a* shows the double-piston compressor according to FIG. 1 in a cross-sectional view.

A first embodiment of a double-piston compressor 1.1 of a compressed air supply device configured according to the invention that can be regarded as the basic design is depicted in FIG. 1 as a longitudinal central view and in FIG. 1*a* as a cross-sectional view. The double-piston compressor 1.1 has a first pressure stage 2 configured as a low-pressure stage and a second pressure stage 3 configured as a high-pressure stage which each have a cylinder 4, 7 with a piston 5, 8 guided axially movably therein. The two pistons 5, 8 are sealed by means of a sealing ring 6, 9 in each case which are preferably configured as sealing collars made of an elastic material such as rubber, for example, sealed with respect to the assigned cylinder 4, 7 and guided therein in a sliding manner. Both cylinders 4, 7 are arranged radially opposite with respect to an axis of rotation 13 of a drive shaft 12. The two pistons 5, 8 are rigidly connected to one another via a piston rod 10 and are in driving connection with the drive shaft 12 via a slotted guide 14.1. The slotted guide 14.1 has a recess 15.1 which is arranged in the piston rod 10, delimited by a closed, elliptical slotted guide track 16.1, and oriented with its cross-sectional plane perpendicular to the axis of rotation 13 of the drive shaft 12, and also a drive roller 17 which is engaged with the slotted guide track 16.1 of the recess 15.1 and fastened to the drive shaft 12 in an axially parallel, eccentric and also rotatable manner with respect to the axis of rotation 13 of the drive shaft 12.

The recess 15.1 and therefore also the slotted guide 14.1 are oriented centrally with respect to a central axis 11 of the piston rod 10. The main axis H of the elliptical slotted guide track 16.1 has a length $L_H$ which falls slightly below the sum of twice the eccentricity e and twice the rolling radius $R_R$ of the drive roller 17 (cf. also FIGS. 13*a-d*; with regard to FIGS. 13*a-d* the effect of the undersize is more accurately depicted). Since the inclination of the slotted guide track 16.1 with respect to a perpendicular 23 to the central axis 11 of the piston rod 10 in the exemplary embodiment according to FIGS. 1 and 1*a* is equal to zero, the formula $L_H<2*(e+R_R)/\cos\alpha$ where [$\cos\alpha=1$] applies to the length $L_H$ of the main axis H. The secondary axis N of the elliptical slotted guide track 16.1 has a length $L_N$ which falls below the sum of twice the eccentricity e and twice the rolling radius $R_R$ of the drive roller 17, so that the formula $L_N<2*(e+R_R)$ applies, wherein this length $L_N$ is at least large enough, however, for the flanging radii $R_E$ of the elliptical slotted guide track 16.1 to be greater than the rolling radius $R_R$ of the drive roller 17 ($R_E>R_R$). The drive roller 17 in the present case is formed by the outer ring 19 of a rolling bearing 18 which is arranged on a bearing bolt 20 fastened eccentrically to the drive shaft 12 about the eccentricity e.

Due to the eccentric arrangement of the bearing bolt 20, a rotation of the drive shaft 12 causes a crank movement of the drive roller 17, wherein the crank movement is converted by the rolling of the drive roller 17 on the closed, elliptical slotted guide track 16.1 of the slotted guide 14.1 into a periodic stroke movement of the piston rod 10 and therefore of the two pistons 5, 8. In this case, the previously mentioned geometry of the elliptical slotted guide track 16.1 in conjunction with a contact force directed against the stroke movement on the pistons 5, 8 in the pressure stroke in each case ensures a continuous rolling contact of the drive roller 17 with the slotted guide track 16.1. Discontinuity in the stroke pattern of the pistons 5, 8 occurring with the known slotted guides and signs of wear through load changes of the drive roller 17 associated with this are thereby avoided.

Since the slotted guide track 16.1 of the slotted guide 14.1 has a planar configuration in the longitudinal profile and the drive roller 17 has a cylindrical outer wall via which the drive roller 17 rolls on the slotted guide track 16.1, an axial displacement of the drive roller 17 with respect to the slotted guide track 16.1 is moreover possible, so that axial displacements of the drive shaft 12 and the drive roller 17 caused by production tolerances and thermal expansion can be balanced in a distortion-free manner.

Figure 1B:
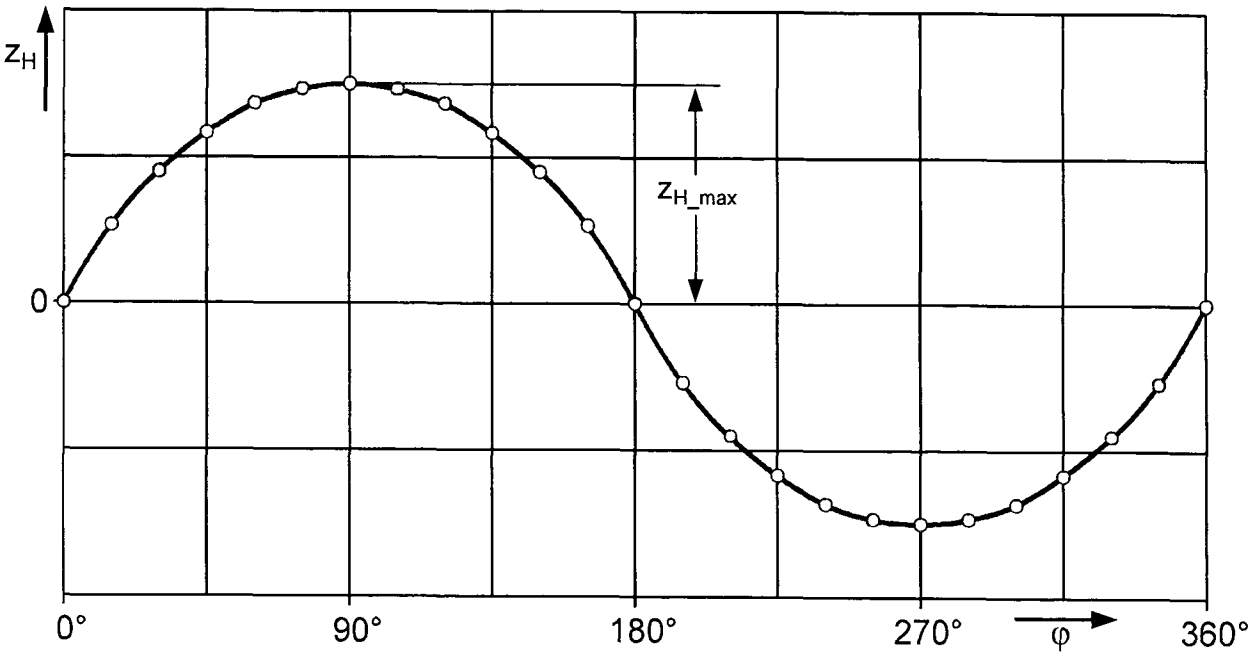
FIG. 1*b* is a graph of the stroke curve of the pistons of the double-piston compressor according to FIGS. 1 and 1*a;*

In the graph in FIG. 1*b*, the stroke curve $z_H(\varphi)$ of the pistons 5, 8 or of the piston rod 10 of the double-piston compressor 1.1 is configured for a rotation of the drive shaft 12, wherein the angle of rotation of the drive shaft 12 is denoted as φ and the direction of rotation of the drive shaft 12 is assumed to be clockwise in accordance with the direction of rotation arrow 21 in the cross-sectional view in FIG. 1*a*. In FIGS. 1 and 1*a*, the bearing bolts 20 and the drive roller 17 are depicted with the drive shaft 12 in a 90°-position. The stroke height of the pistons 5, 8 is referred to as $z_H$ in the graph in FIG. 1*b*, wherein the stroke direction of the pistons 5, 8 is assumed to be positive in accordance with the stroke direction arrow 22 depicted in FIG. 1 in the direction of the cylinder 7 in the high-pressure stage 3. The stroke curve $z_H(\varphi)$ of the pistons 5, 8 depicted in the graph in FIG. 1*b* has a regular sinusoidal profile, the amplitude whereof $z_{H_max}$ results from the sum of the eccentricity e and the rolling radius $R_R$ of the drive roller 17 reduced by half the length $L_N$ of the secondary axis N of the elliptical slotted guide track 16.1, so that the equation $z_{H_max}=e+R_R-L_N/2$ applies.

Figure 2:
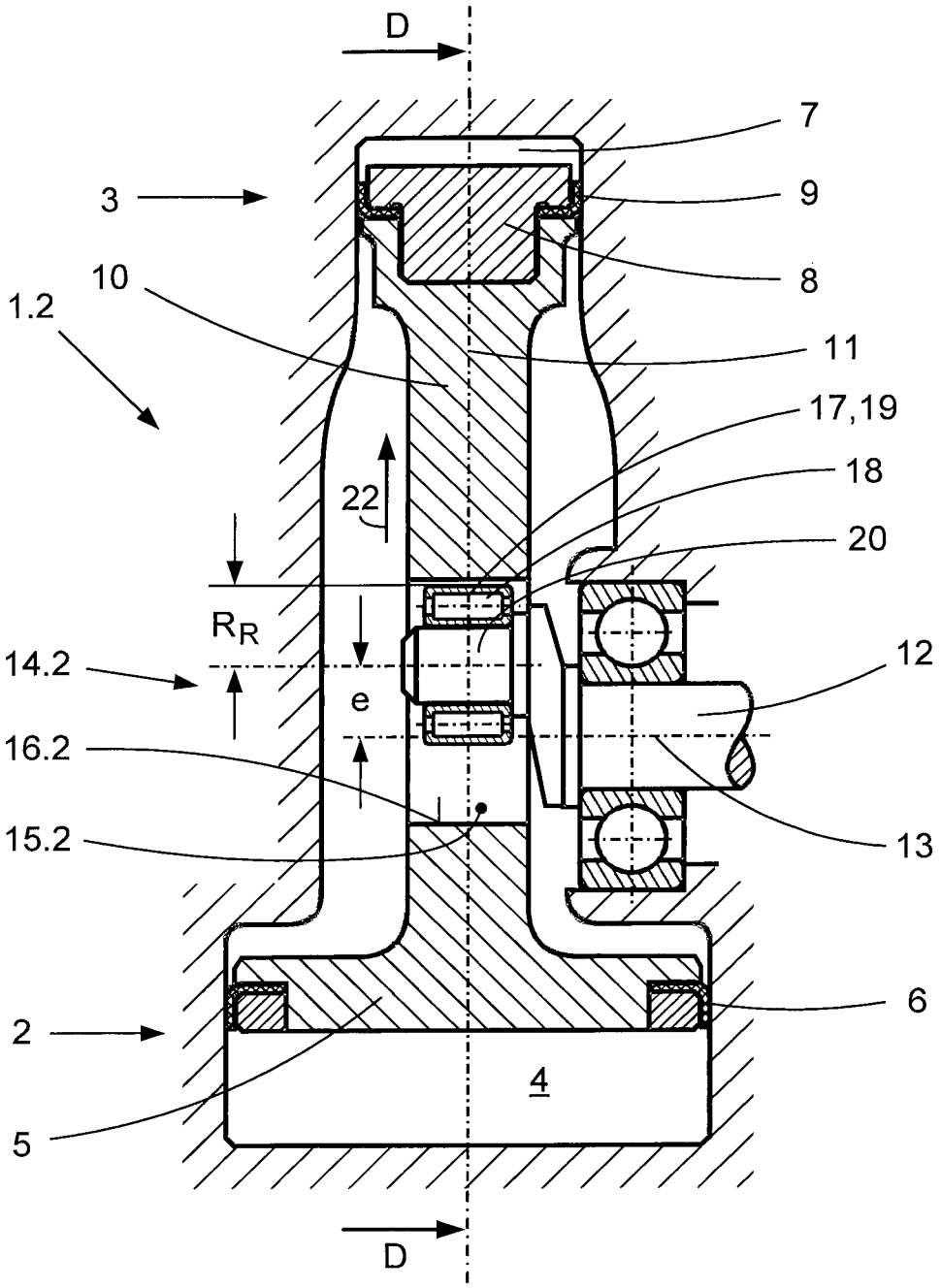
FIG. 2 shows a double-piston compressor according to a second embodiment of the invention in a longitudinal central section.
Figure 2A:
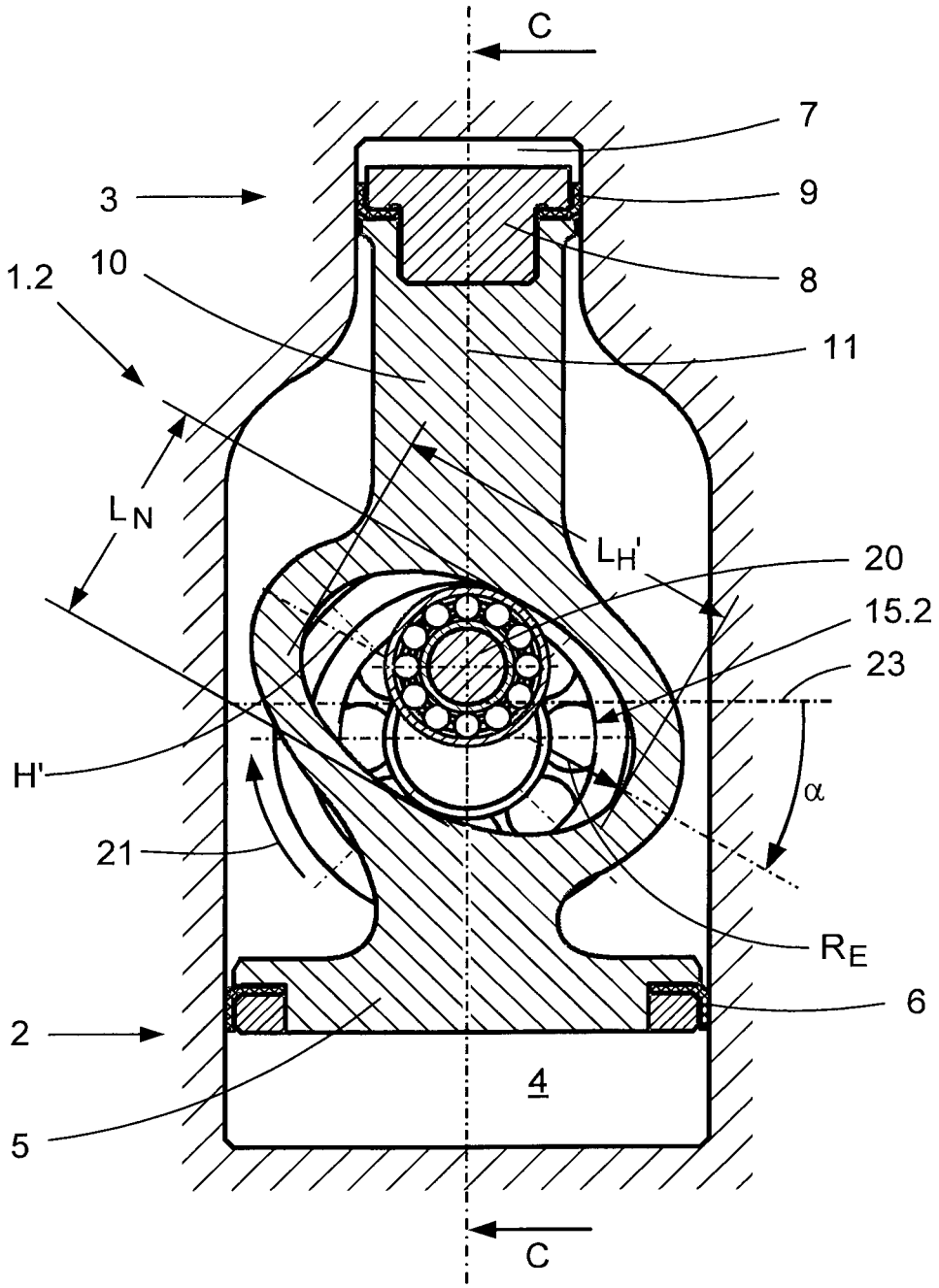
FIG. 2*a* shows the double-piston compressor according to FIG. 2 in cross-sectional view.

A second embodiment according to the invention of a double-piston compressor 1.2 of a compressed air supply device is depicted in FIG. 2 in a longitudinal central section and in FIG. 2*a* in a cross-sectional view. This embodiment of the double-piston compressor 1.2 differs due to a modified arrangement of the slotted guide track 14.2 from the double-piston compressor 1.1 according to FIG. 1. The recess 15.2 with the elliptical slotted guide track 16.2 is arranged in a twisted manner with respect to a perpendicular 23 to the central axis 11 of the piston rod 10 about the angle of inclination of $\alpha=30°$ in the present case in the direction of rotation 21 of the drive shaft 12. Due to the shortening of the projection to the perpendicular 23 caused by the inclination, the main axis H' of the elliptical slotted guide track 16.2 has a correspondingly greater length $L_H'$ which falls slightly short of the sum of twice the eccentricity e and twice the rolling radius $R_R$ of the drive roller 17 divided by the cosine of the angle of inclination α of the main axis H'($L_H'<2*(e+R_R)/\cos\alpha$ where [$\cos\alpha>0$]). In this way, on the one hand the movability of the drive roller 17 in the slotted guide track 14.2 and, on the other hand, the contact of the drive roller 17 in the lateral regions of the slotted guide track 16.2 is guaranteed (cf. also FIGS. 13*a-d*).

Figure 2B:
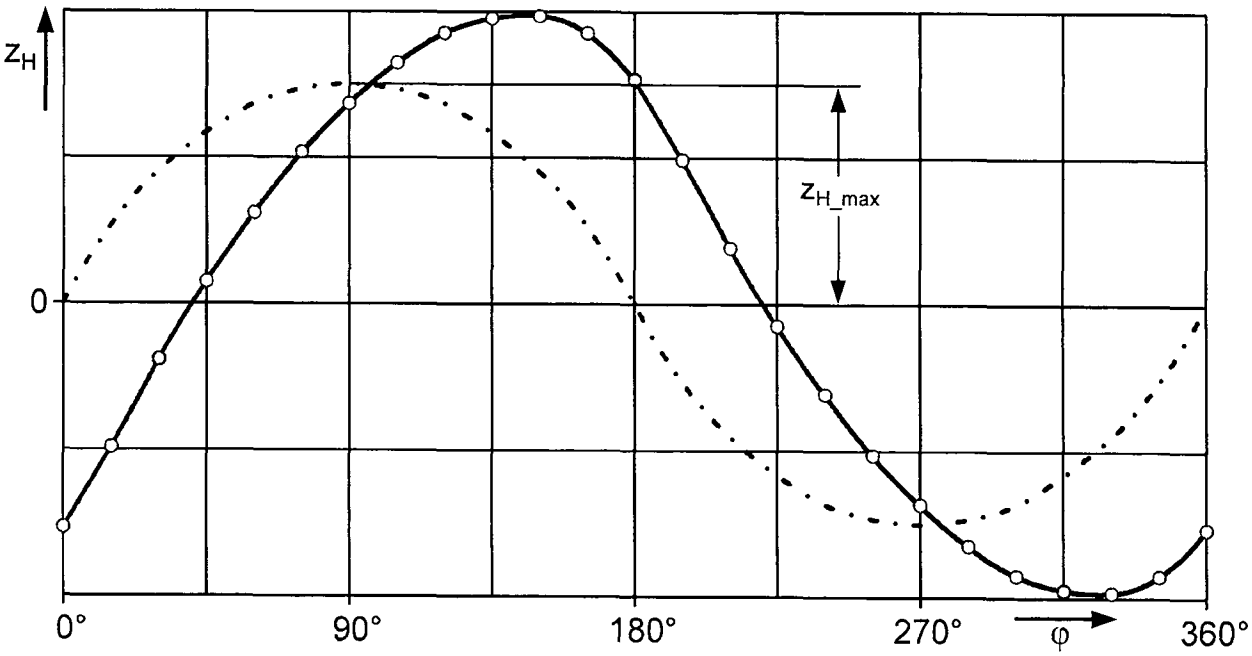
FIG. 2*b* is a graph of the stroke curve of the pistons of the double-piston compressor according to FIG. 2 and FIG. 2*a;*

The stroke curve $z_H(\varphi)$ of the pistons 5, 8 or else of the piston rod 10 of the double-piston compressor 1.2 depicted in the graph in FIG. 2*b* has a modified sinusoidal profile which, due to the arrangement of the elliptical slotted guide track 16.2 inclined in the direction of rotation 21 of the drive shaft 12, exhibits a phase displacement in the retarded direction and a stroke height extending beyond the stroke height $z_{H_max}$ with a perpendicular arrangement of the slotted guide track 16.1 according to FIG. 1 and FIG. 1*a*. For comparison purposes, in FIG. 2*b* the stroke curve $z_H(\varphi)$ of the pistons 5, 8 of the double-piston compressor 1.1 according to FIGS. 1 and 1*a* is drawn in from FIG. 1*b* as a dot-dash curve.

Figure 3:
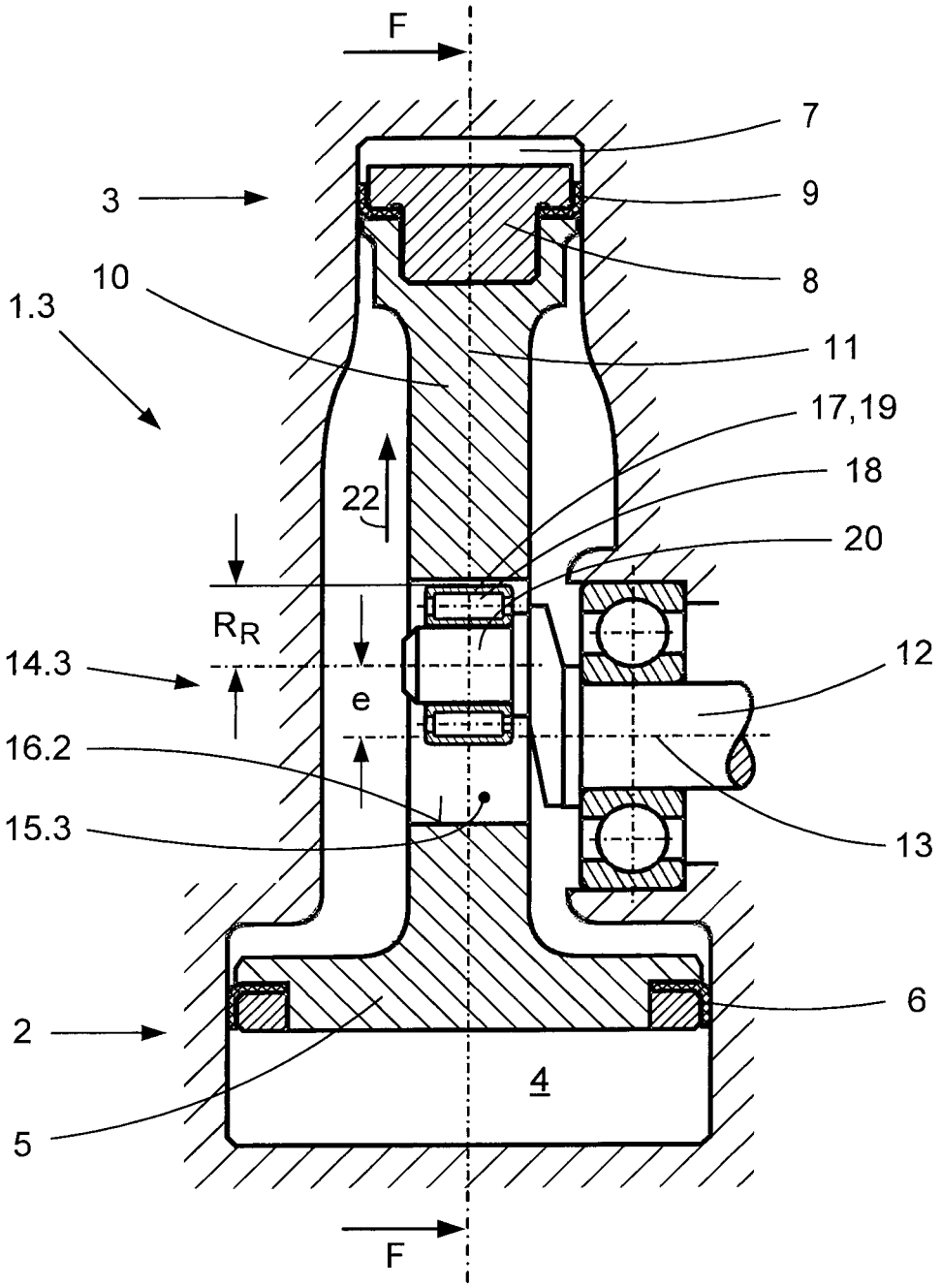
FIG. 3 shows a double-piston compressor according to a third embodiment of the invention in a longitudinal central section.
Figure 3A:
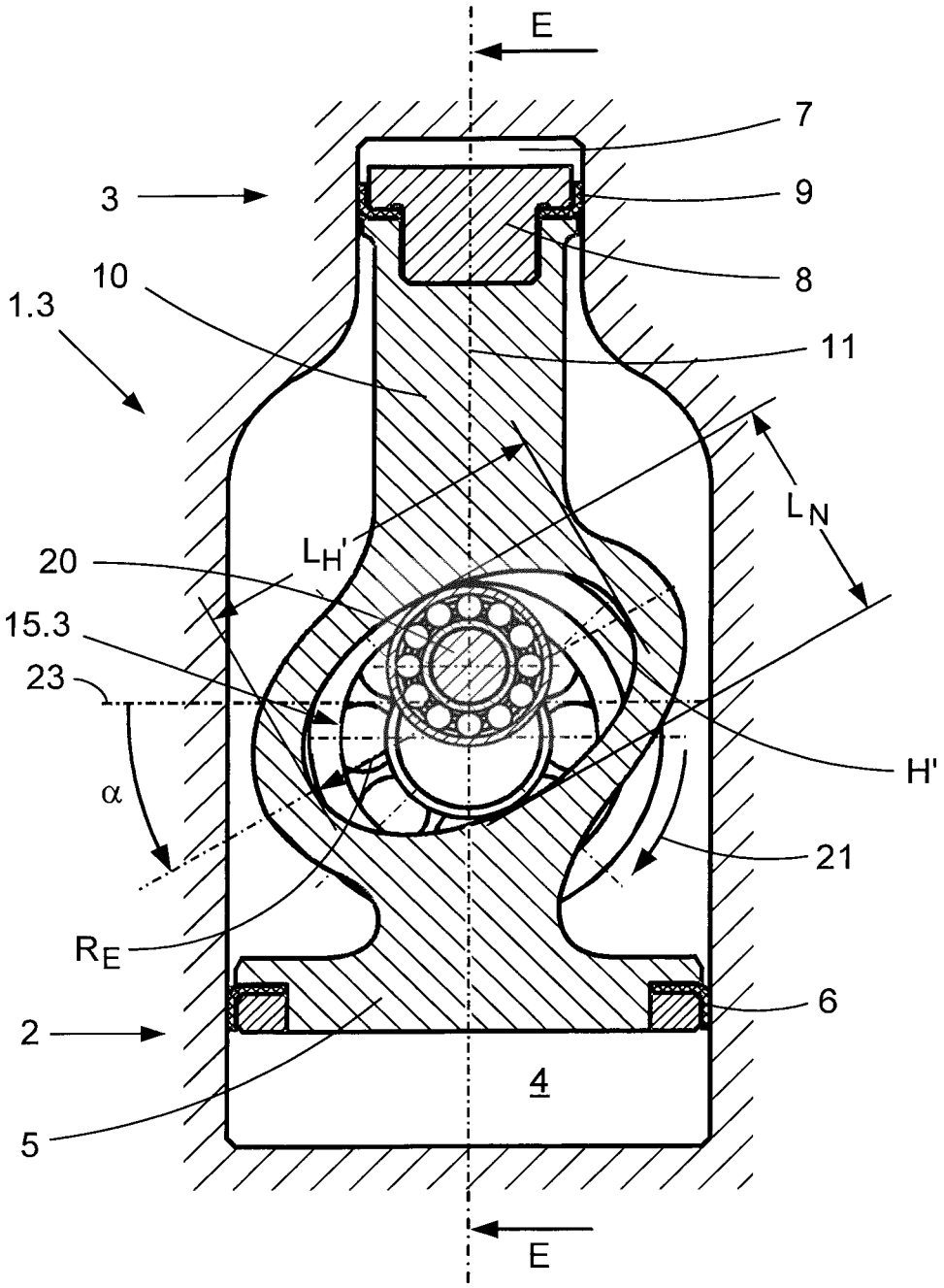
FIG. 3*a* shows a double-piston compressor according to FIG. 3 in a cross-sectional view.

A third embodiment according to the invention of a double-piston compressor 1.3 of a compressed air supply device is depicted in FIG. 3 as a longitudinal central section and in FIG. 3*a* in a cross-sectional view. This embodiment of the double-piston compressor 1.3 is distinguished from the double-piston compressor 1.1 according to FIG. 1 by an arrangement of the slotted guide 14.3 modified in another way. In this case, the recess 15.3 with the elliptical slotted guide track 16.2 is arranged in a twisted manner with respect to the perpendicular 23 to the central axis 11 of the piston rod 10 about an angle of inclination of $\alpha=-30°$ against the direction of rotation 21 of the drive shaft 12. In this case too, the main axis H' of the elliptical slotted guide track 16.2 has a correspondingly greater length $L_H'$ due to the shortening of the projection to the perpendicular 23 caused by the inclination, which length falls slightly short of the sum of twice the eccentricity e and twice the rolling radius $R_R$ of the drive roller 17 divided by the cosine of the angle of inclination $\alpha$ of the main axis H' ($L_H'<2*(e+R_R)/\cos\alpha$ where [$\cos\alpha>0$]).

Figure 3B:
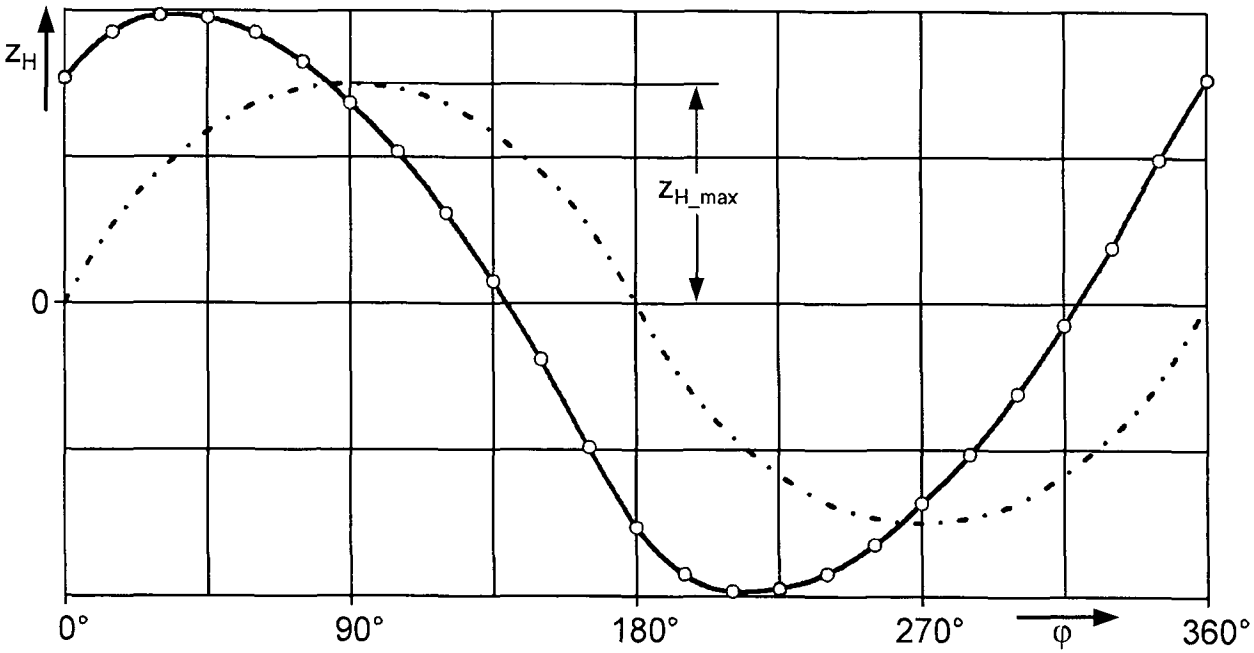
FIG. 3*b* is a graph of the stroke curve of the pistons of the double-piston compressor according to FIGS. 3 and 3*a;*

The stroke curve $z_H(\varphi)$ of the pistons 5, 8 or else of the piston rod 10 of the double-piston compressor 1.3 depicted in the graph in FIG. 3*b* has a modified sinusoidal profile which, due to the arrangement of the elliptical slotted guide track 16.2 inclined against the direction of rotation 21 of the drive shaft 12, exhibits a phase displacement in the advanced direction and also a stroke height extending beyond the stroke height $z_{H_max}$ with a perpendicular arrangement of the slotted guide track 16.1 according to FIG. 1 and FIG. 1*a*. For comparison purposes, in FIG. 3*b* the stroke curve $z_H(\varphi)$ of the pistons 5, 8 of the double-piston compressor 1.1 according to FIGS. 1 and 1*a* is also drawn in from FIG. 1*b* as a dot-dash curve.

Figure 4:
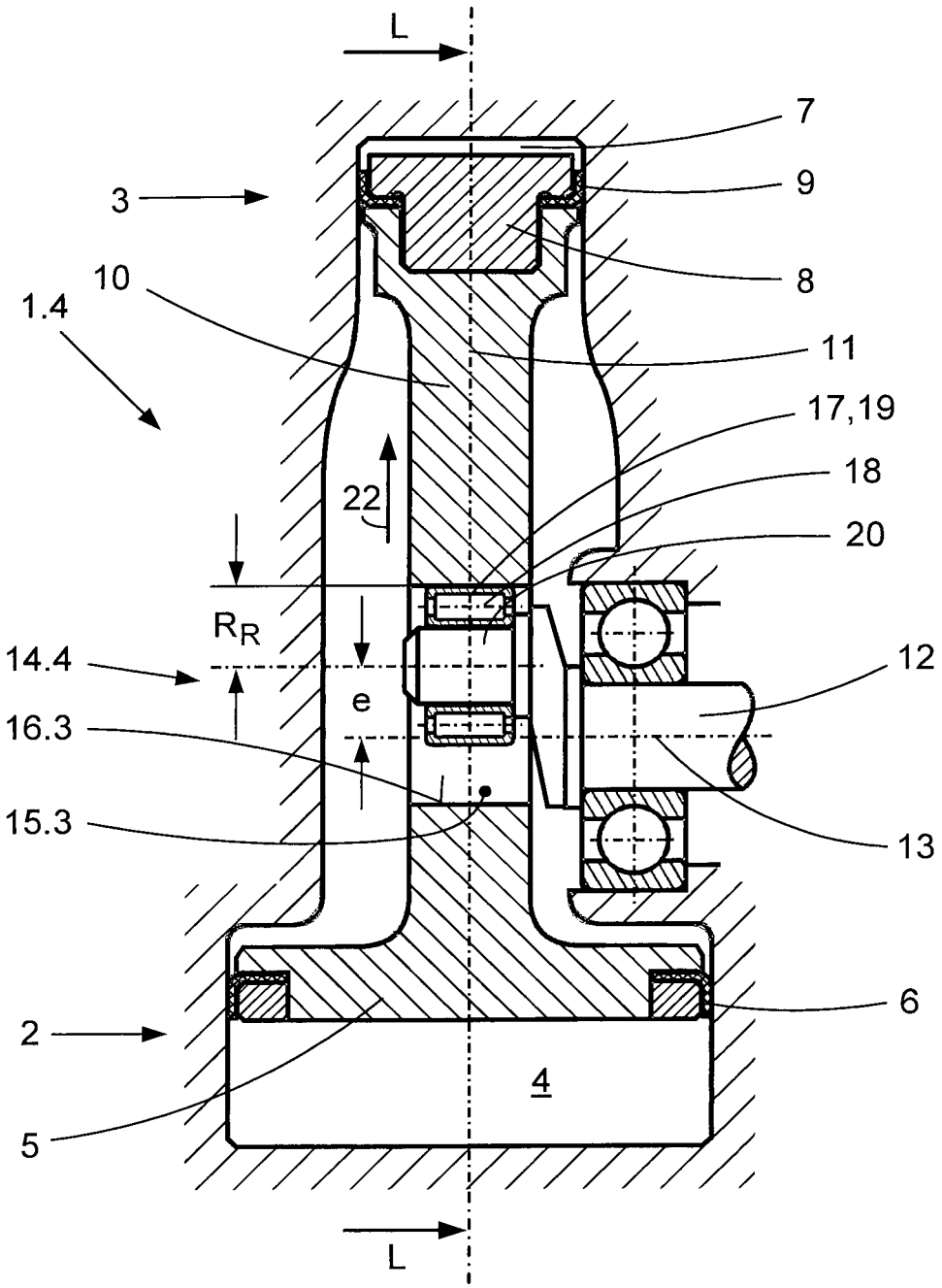
FIG. 4 shows a double-piston compressor according to a fourth embodiment of the invention in a longitudinal central section.
Figure 4A:
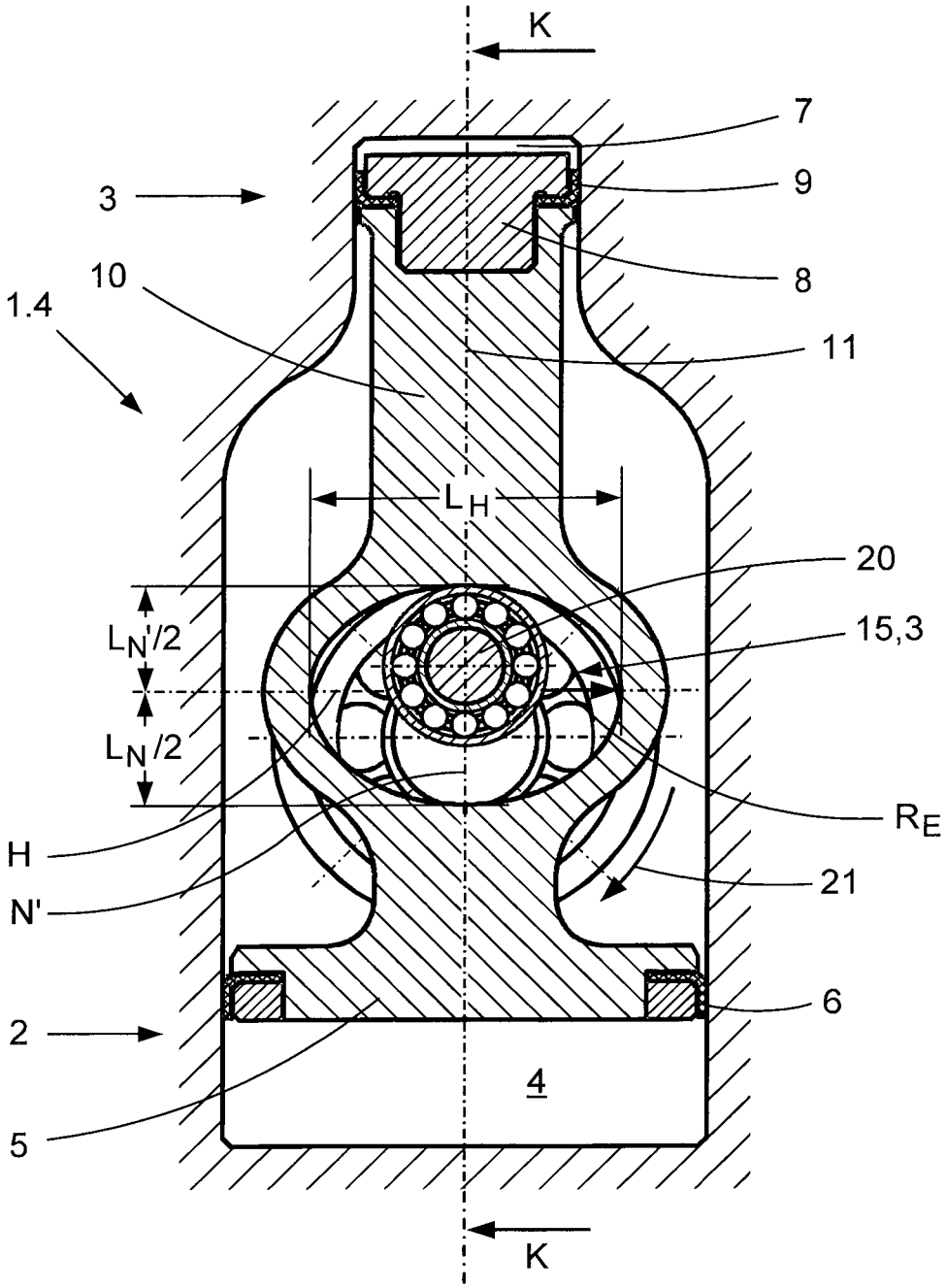
FIG. 4*a* shows the double-piston compressor according to FIG. 4 in a cross-sectional view.

A fourth embodiment according to the invention of a double-piston compressor 1.4 of a compressed air supply device is depicted in FIG. 4 as a longitudinal central section and in FIG. 4*a* as a cross-sectional view. This embodiment of the double-piston compressor 1.4 is distinguished from the double-piston compressor 1.1 according to FIG. 1 by a modified arrangement of the slotted guide 14.4. While the elliptical slotted guide tracks 16.1, 16.2 in the case of the slotted guides 14.1, 14.2, 14.3 described hitherto are each symmetrically configured, the slotted guide 14.4 shown in FIGS. 4 and 4*a* is asymmetrically configured in the recess 15.3 with different lengths $L_N/2$, $L_N'/2$ of the two semi-axes of the secondary axis N' of the elliptical slotted guide track 16.3. In the present case, the semi-axis of the secondary axis N' which faces the piston 8 of the high-pressure stage 3 has a shorter length $L_N'/2$ auf ($L_N'/2<L_N/2$) compared with the length $L_N/2$ of the other semi-axis of the secondary axis N'. In this way, the stroke height of the pressure stroke of the piston 8 in the high-pressure stage 3 and the stroke height of the intake stroke of the piston 5 in the low-pressure stage 2 are greater to the same extent compared with the stroke height in the opposite direction ($z_{H_max}'=e+R_R-L_N'/2>z_{H_max}=e+R_R-L_N/2$).

Figure 4B:
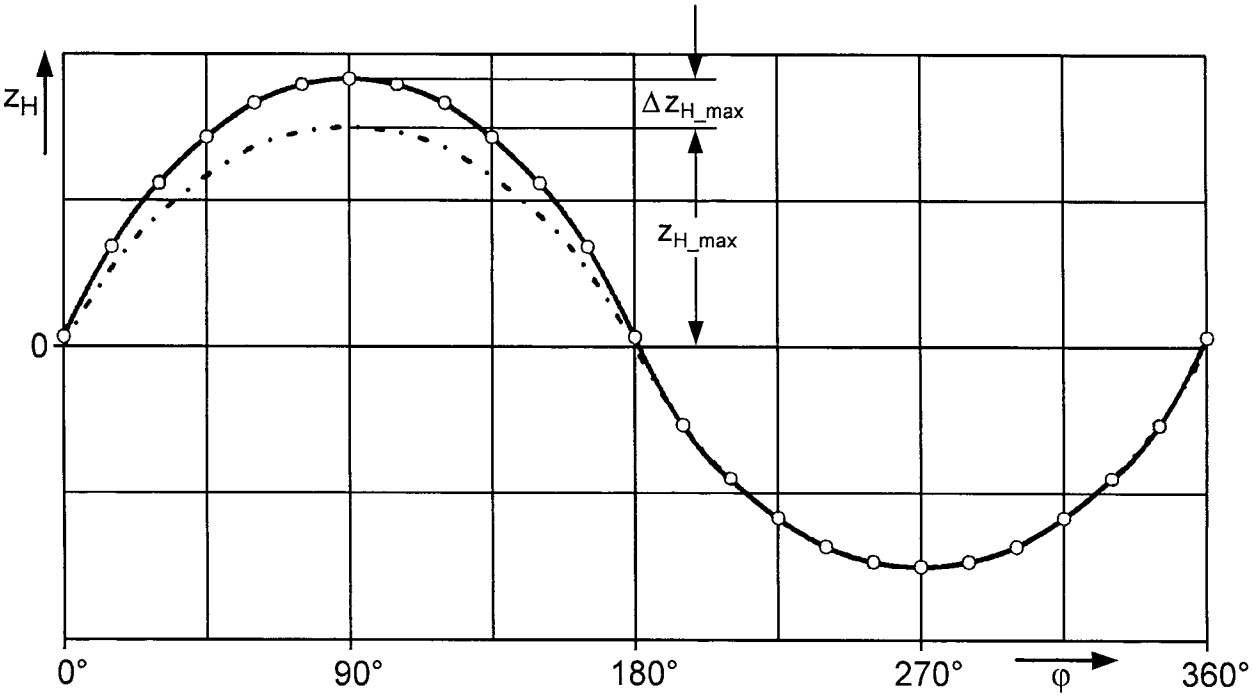
FIG. 4*b* is a graph of the stroke curve of the pistons of the double-piston compressor according to FIGS. 4 and 4*a;*

The stroke curve $z_H(\varphi)$ of the pistons 5, 8 or else of the piston rod 10 of the double-piston compressor 1.4 depicted in the graph in FIG. 4*b* has an asymmetric sinusoidal profile with respect to the central axis which, due to the shorter length $L_N'/2$ of the semi-axis of the secondary axis N' of the elliptical slotted track 16.3 facing the piston 8 in the high-pressure stage 3, has a greater stroke height $z_{H_max}'$ in the stroke direction 22. For comparison purposes, in FIG. 4*b* the stroke curve $z_H(\varphi)$ of the pistons 5, 8 of the double-piston compressor 1.1 according to FIGS. 1 and 1*a* is drawn in from FIG. 1*b* as a dot-dash curve. For illustrative purposes, the difference between the stroke heights $\Delta z_{H_max}=z_{H_max}'-z_{H_max}$ designated $\Delta z_{H_max}$ is also drawn in to FIG. 4*b*.

Figure 5:
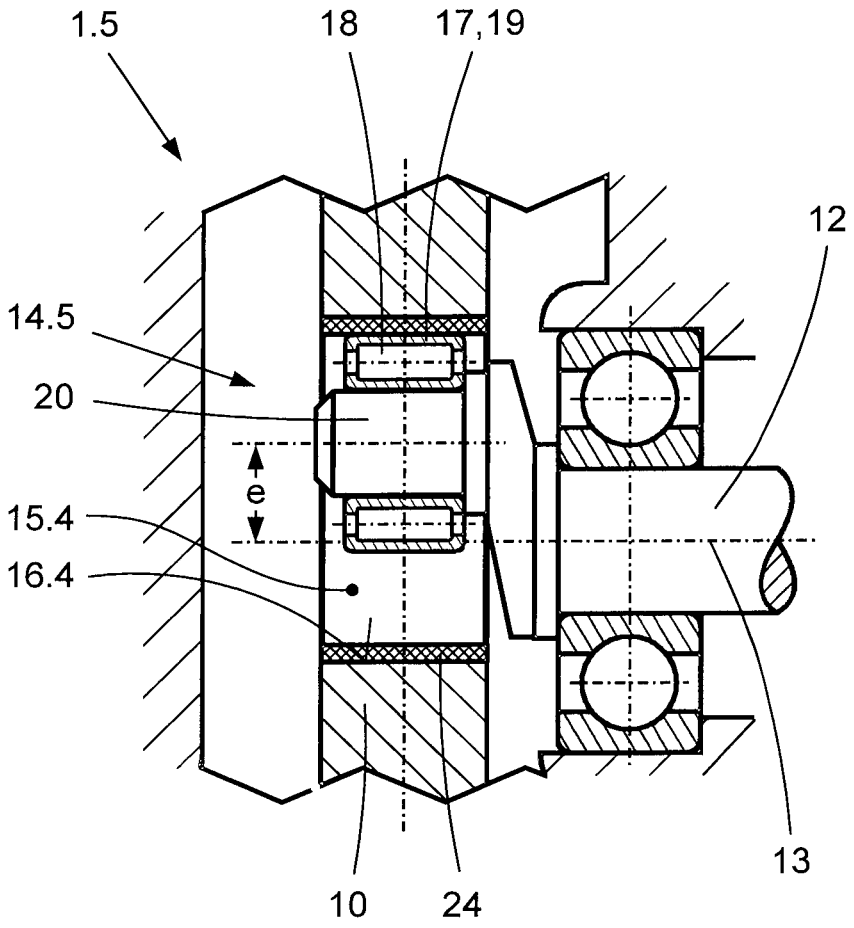
FIG. 5 shows a double-piston compressor according to a fifth embodiment of the invention in a sectional longitudinal central section.

A fifth embodiment according to the invention of a double-piston compressor 1.5 of a compressed air supply device is depicted in FIG. 5 as a sectional longitudinal central section. In this embodiment of the slotted guide 14.5, the elliptical slotted guide track 16.4 with a correspondingly enlarged recess 15.4 is coated with a spring-elastic layer 24 preferably made of rubber. In this case, the lateral radial contact force of the drive roller 17 generated by the undersize of the main axis H of the elliptical slotted guide track 16.4 in conjunction with a small radial displacement of the piston rod 10 in addition to the sealing collars 6, 9 is also elastically supported via the spring-elastic layer 24.

Figure 6:
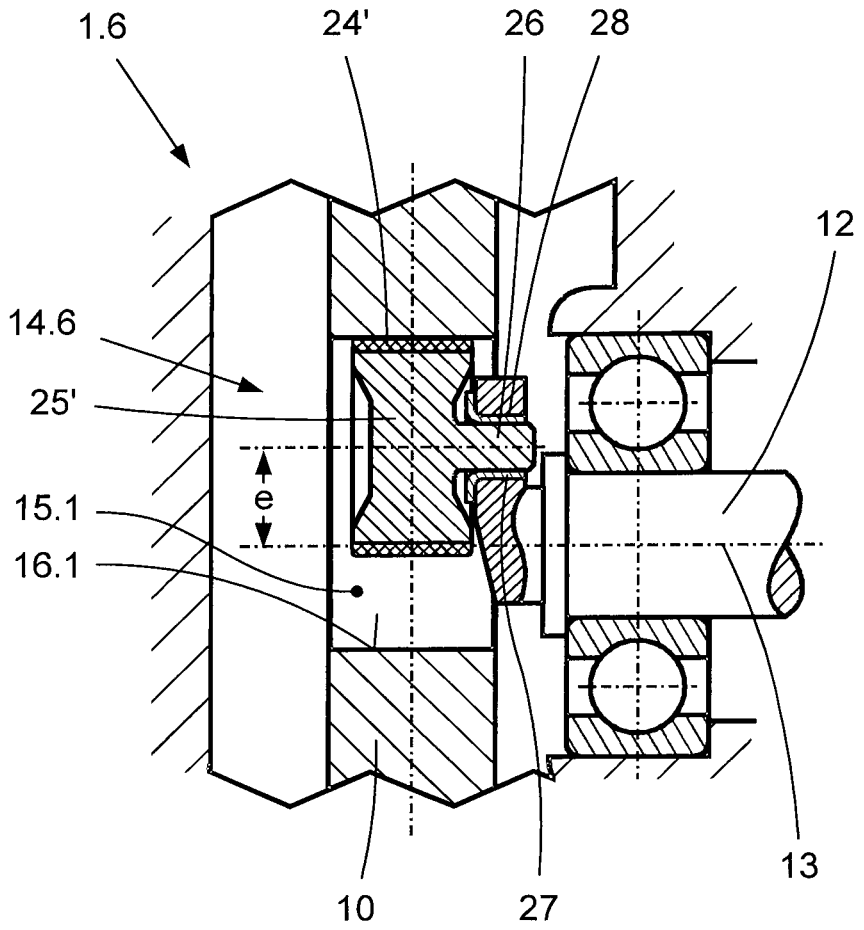
FIG. 6 shows a double-piston compressor according to a sixth embodiment of the invention in a sectional longitudinal central section.

In a sixth embodiment of a double-piston compressor 1.6 of a compressed air supply device according to the invention which is an alternative to this and depicted in FIG. 6 as a sectional longitudinal central section, with the slotted guide 14.6 in this case in the recess 15.1 the drive roller 25' is coated with a spring-elastic layer 24' preferably made of rubber with a corresponding reduction in its outer diameter. In FIG. 6 the drive roller 25' is configured by way of example as an alternative to the previously described embodiment of the drive roller 17. In this case the drive roller 25' is configured as a cylindrical plate and rigidly connected to a central bearing bolt 26 which is rotatably mounted via a slide bearing 27 in a bearing bore 28 arranged eccentrically on the drive shaft 12 about the eccentricity e.

Figure 7:
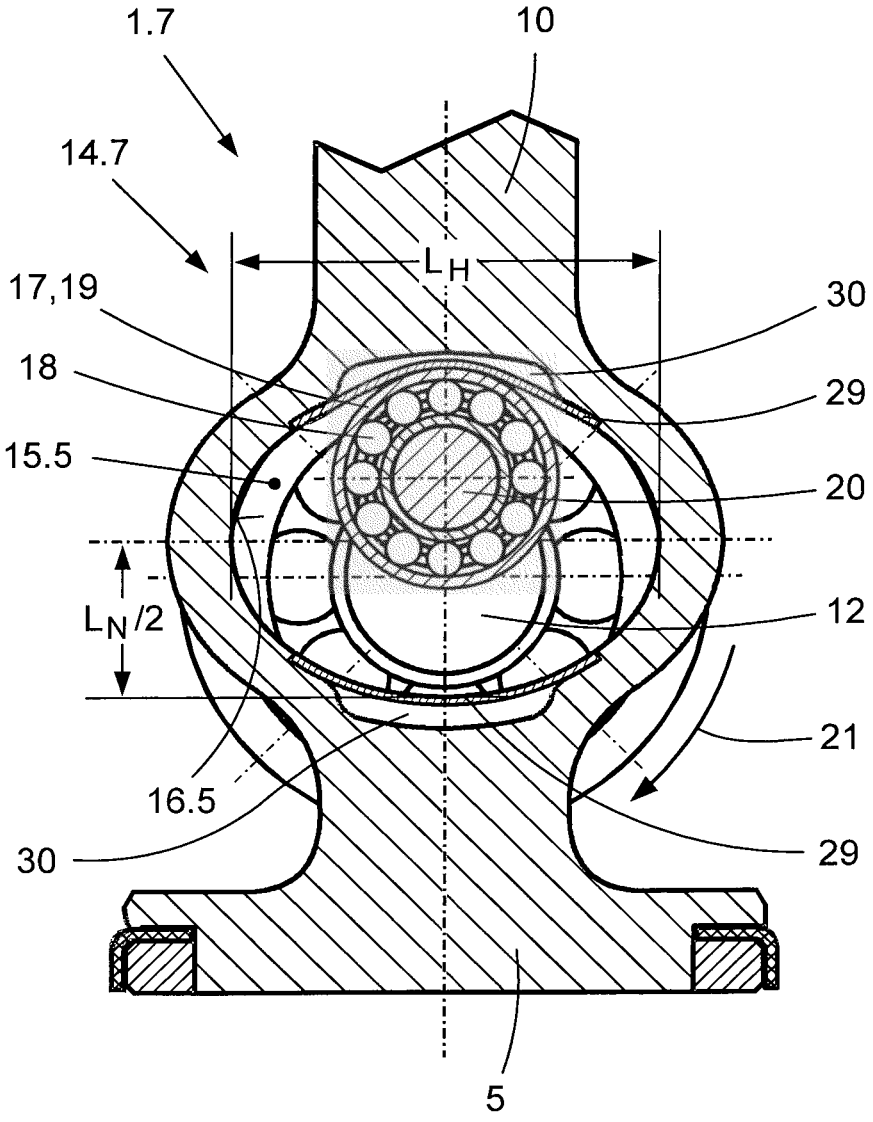
FIG. 7 shows a double-piston compressor according to a seventh embodiment of the invention in a sectional cross-sectional view.
Figure 8:
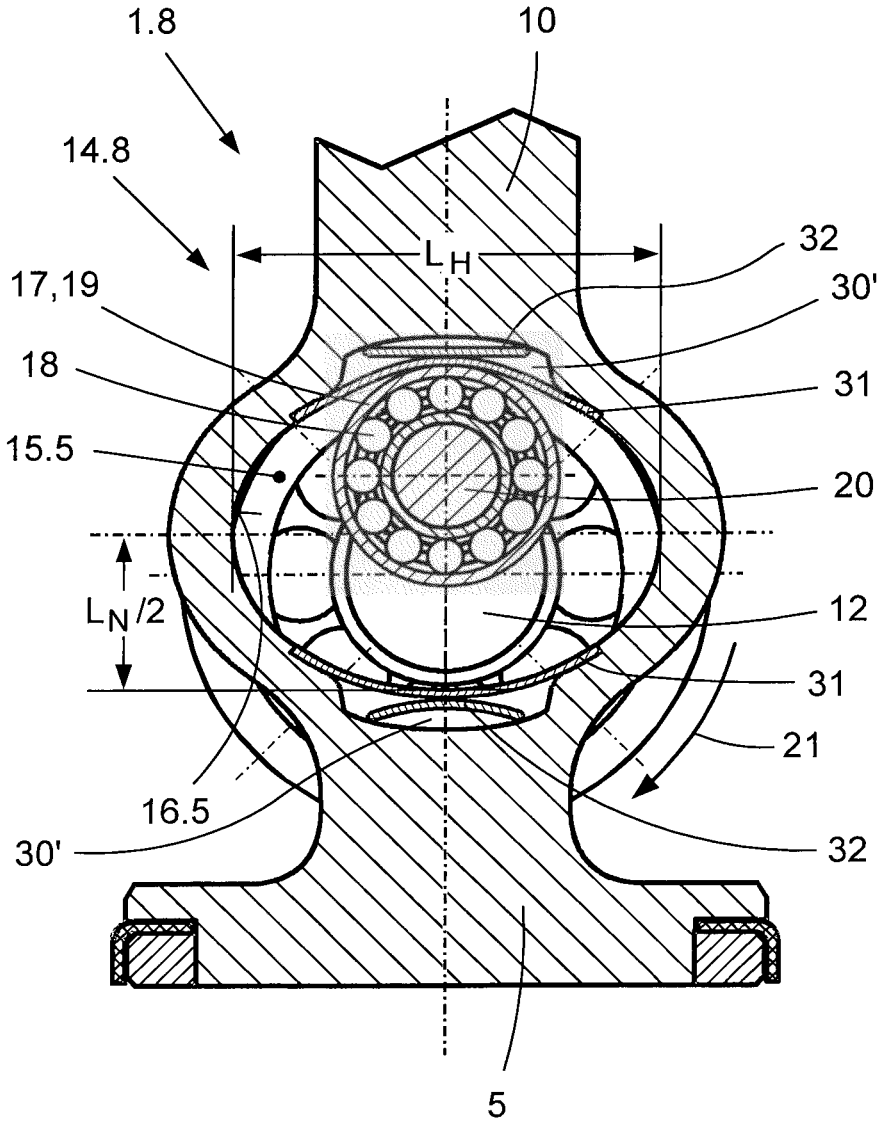
FIG. 8 shows a double-piston compressor according to an eighth embodiment of the invention in a sectional cross-sectional view.

In FIGS. 7 and 8 a seventh and eighth embodiment according to the invention of a double-piston compressor 1.7, 1.8 of a compressed air supply device are each depicted as a sectional cross-sectional view in which the portions which are central in their longitudinal extent of the elliptical slotted guide track 16.5 of the slotted guide 14.7, 14.8 in each case are each designed to be capable of buckling automatically in a load-dependent manner in the recesses 15.5 in the piston rod 10. In the embodiment of the slotted guide 14.7 according to FIG. 7, the walls 29 of the aforementioned central portions of the slotted guide track 16.5 have a spring-elastic design and each span a cavity 30 in the piston rod 10. In the embodiment of the slotted guide 14.8 according to FIG. 8, the walls 31 of the central portions of the slotted guide track 16.5 have a bending-elastic design and each span a cavity 30' in the piston rod 10, in which a compression spring 32 is arranged in each case which is in contact with the respective wall 31 and in the present case is configured as a bow spring, by way of example. Due to the possible buckling of the aforementioned central portions of the slotted guide track 16.5 caused by this, the stroke height of the pressure stroke of the facing piston 5, 8 in each case is reduced in a force-dependent manner and the peak loading of the slotted guide 14.7, 14.8 is therefore reduced. In FIGS. 7 and 8, the wall 19, 31 of the slotted guide track 16.5 facing the piston 7 in the high-pressure stage 3 is depicted buckling in each case through the roller 17 located in the 90° position. The radially opposite wall 19, 31 of the slotted guide track 16.5, on the other hand, is depicted in each of the FIGS. 7 and 8 in the non-buckling form.

With the previously described embodiments of the slotted guide tracks 14.1-14.8, the slotted guide track 16.1-16.5 has a planar design in the longitudinal profile in each case and the drive roller 17, 25' has a cylindrical outer wall in each case with which the drive roller 17, 25' rolls on the respective slotted guide 16.1-16.5. Due to these contours between the slotted guide track 16.1-16.5 and the drive roller 17, 25' which are planar in the axial direction of the drive shaft 12, a rotational guide of the piston rod 10 is produced, which means that anti-twist protection of the pistons 5, 8 is superfluous. In addition, an axial displacement of the drive roller 17, 25' with respect to the slotted guide track 16.1-16.5 is thereby possible, which means that axial displacements of the drive shaft 12 or of the drive roller 17, 25' caused by production tolerances and thermal expansion can be balanced in a non-distorted manner.

Figure 9:
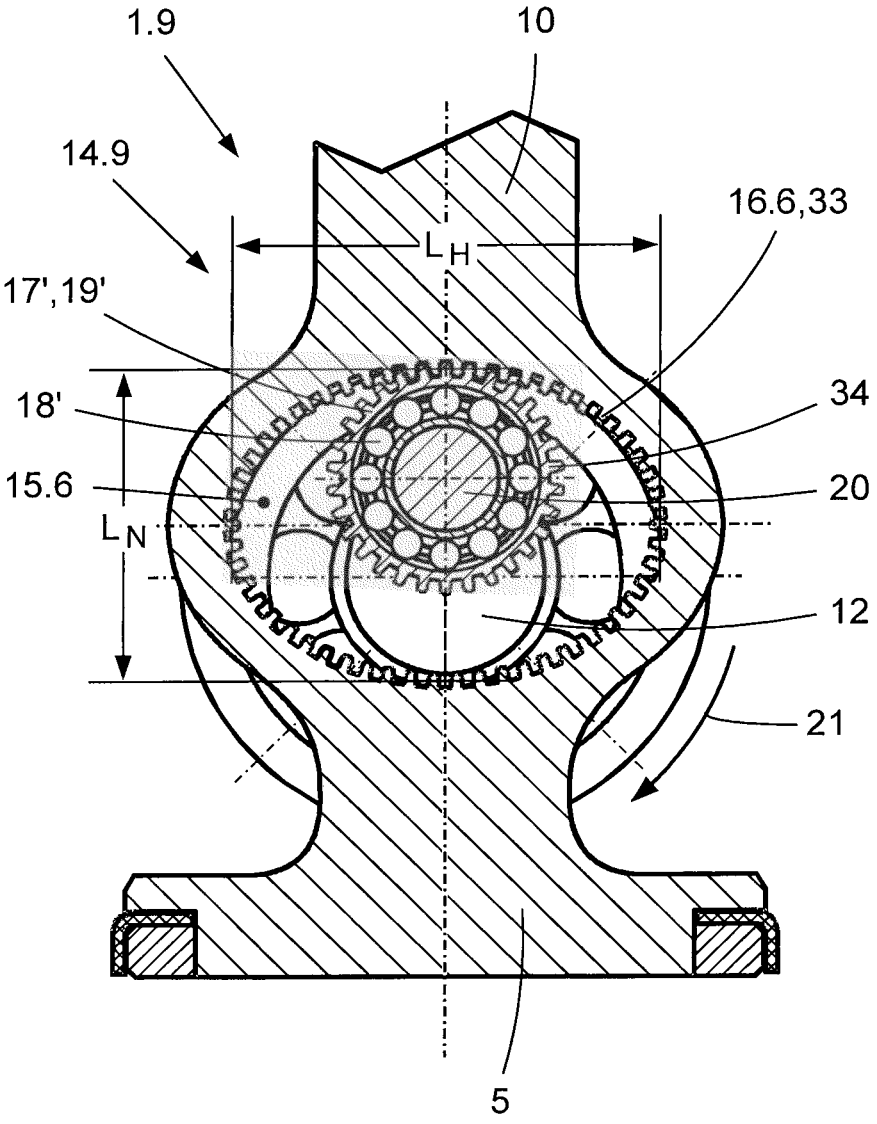
FIG. 9 shows a double-piston compressor according to a ninth embodiment of the invention in a sectional cross-sectional view.

Based on the double-piston compressor 1.1 according to FIGS. 1 and 1*a*, a ninth embodiment of a double-piston compressor 1.9 of a compressed air supply device according to the invention depicted as a sectional cross-sectional view in FIG. 9 is distinguished by an inner toothing 33 of the slotted guide track 16.6 delimiting the recess 15.6 and also an outer toothing on the drive roller 17' of the slotted guide 14.9. Consequently, the slotted guide track 16.6 of the slotted guide 14.9 is provided with a circumferential inner toothing 33 and the drive roller 17' has on its outer wall formed by the outer ring 19' of a roller bearing 18' an outer toothing 34 with the same tooth pitch, via the pitch circle whereof the drive roller 17' rolls on the pitch circle of the inner toothing 33 of the slotted guide track 16.6. The toothing engagement means that a continuous rolling contact of the drive roller 17' with the slotted guide track 16.6 is ensured. A slight reduction in the length $L_H$ of the main axis H of the elliptical slotted guide track 16.6 to produce a lateral radial contact force of the drive roller 17' and the previously described measures for the elastic support of this contact force are not therefore necessary in this embodiment of the slotted guide 14.9. The expenditure involved in producing the toothing is relatively high, however. Also with this embodiment of the slotted guide 14.9, a rotational guide of the piston rod 10 is produced and an axial displacement of the drive roller 17' with respect to the slotted guide track 16.6 is made possible.

Figure 10:
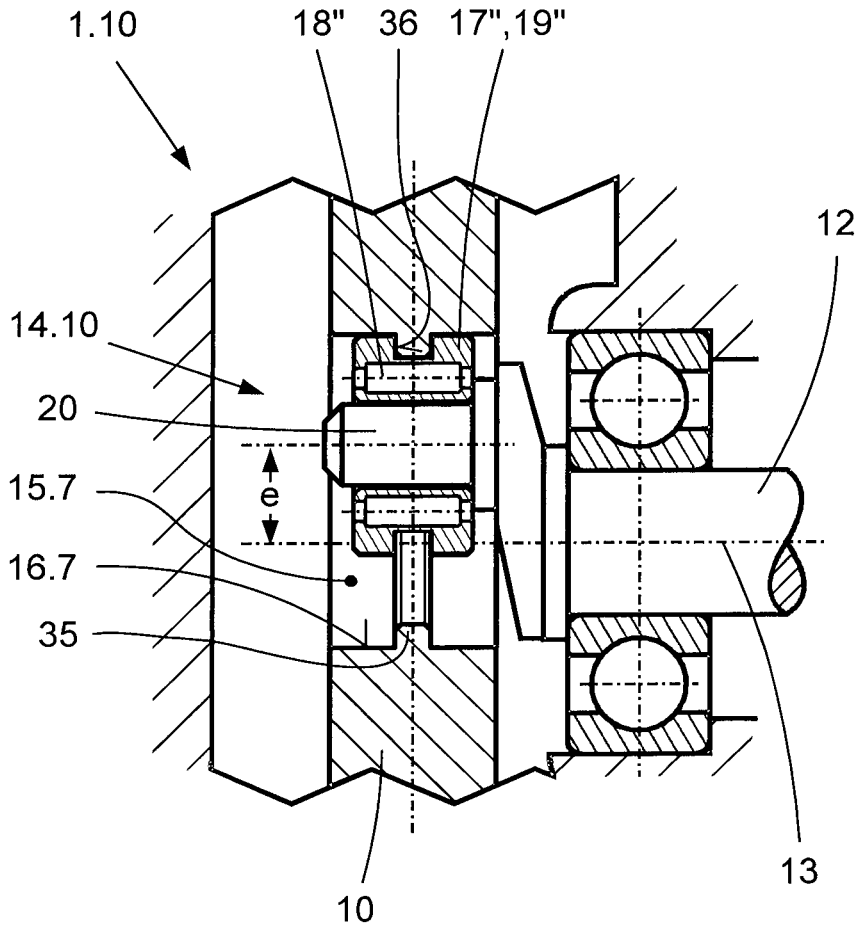
FIG. 10 shows a double-piston compressor according to a tenth embodiment of the invention in a sectional longitudinal center section.

FIG. 10 shows a tenth embodiment according to the invention of a double-piston compressor 1.10 of a compressed air supply device as a sectional longitudinal central section in which the drive roller 17" and the drive shaft 12 connected thereto are guided axially via the slotted guide 14.10 in the piston rod 10. With this embodiment of the slotted guide track 14.10, the slotted guide track 16.7 delimiting the recess 15.7 is provided with a circumferential inner web 35 and the drive roller 17" has on its radial outer wall, configured as an outer ring 19" of a roller bearing 18", a circumferential annular groove 36 with which the inner web 35 of the slotted guide track 16.7 engages for the axial guiding of the drive roller 17".

Figure 11:
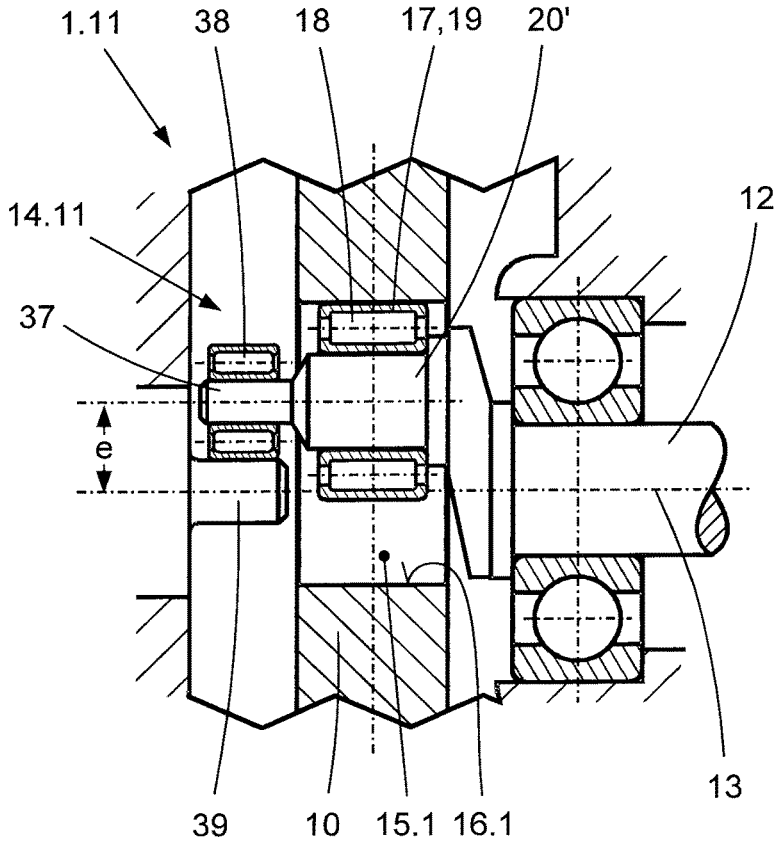
FIG. 11 shows a double-piston compressor according to an eleventh embodiment of the invention in a sectional longitudinal central section.
Figure 12:
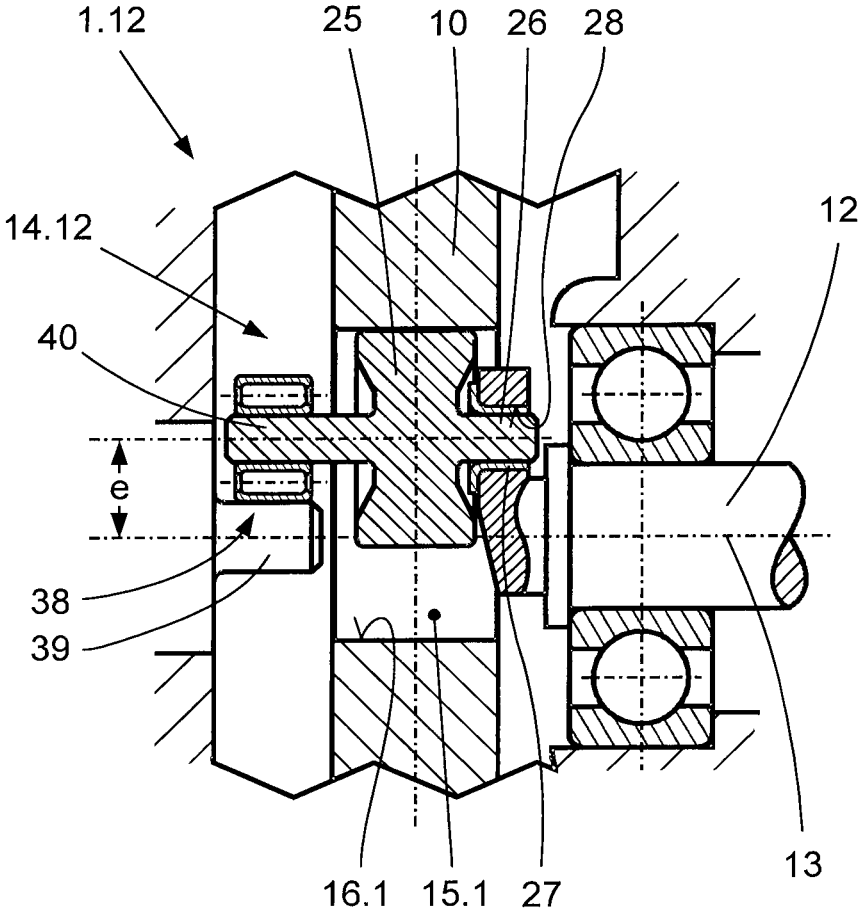
FIG. 12 shows a double-piston compressor according to a twelfth embodiment in a sectional longitudinal central section.

In FIGS. 11 and 12, an eleventh embodiment according to the invention and a twelfth embodiment according to the invention of a double-piston compressor 1.11, 1.12 of a compressed air supply device are each depicted in a sectional longitudinal central section, in which the drive roller 17, 25 and the drive shaft 12 are each provided with an additional bearing. In the embodiment of the double-piston compressor 1.11 according to FIG. 11, the drive roller 17 and also the slotted guide track 16.1 of the slotted guide 14.11 delimiting the recess 15.1 exhibit the design known from FIGS. 1 to 4 and also 7 and 8. For additional bearing, however, in this case the bearing bolt 20' of the drive roller 17 is provided with a central, axially outer bearing shaft 37 which is supported via a roller bearing 38 radially outwardly on a bearing pin 39 fastened at the housing end coaxially to the axis of rotation 13 of the drive shaft 12.

In the embodiment of the double-piston compressor 1.12 according to FIG. 12, the drive roller 25 without the spring-elastic layer 24' corresponds to the design shown in FIG. 6. For the additional bearing, in the case of this slotted guide 14.12 the drive roller 25 itself is provided with a central, axially outer bearing shaft 40 which is supported via a roller bearing 38 radially outwardly on the bearing pin 39 fastened at the housing end coaxially to the axis of rotation 13 of the drive shaft 12.

FIGS. 13*a* to 13*d* again illustrate the state when an undersize of the main axis H of the elliptical slotted guide track 16 is provided and therefore the lateral distance of the slotted guide track 16 is smaller by an amount Δ than the sum of twice the eccentricity e and twice the rolling radius $R_R$ of the drive roller 17.

In FIGS. 13*a* to 13*d*, the elements are depicted using the same reference numbers as in the first twelve exemplary embodiments, wherein the suffix figures are dispensed with and to this extent, for example, FIG. 1 denotes the double-piston compressor without a suffix for particular exemplary embodiments, as the schematic representations in FIGS. 13*a* to 13*d* relate to all exemplary embodiments equally.

For simplicity's sake, the recess 15 is depicted as a horizontally oriented ellipse with a horizontally oriented main axis H. The central axis of the piston is designated 11 and a central axis of the double-piston compressor 1 is designated 41.

Figure 13A:
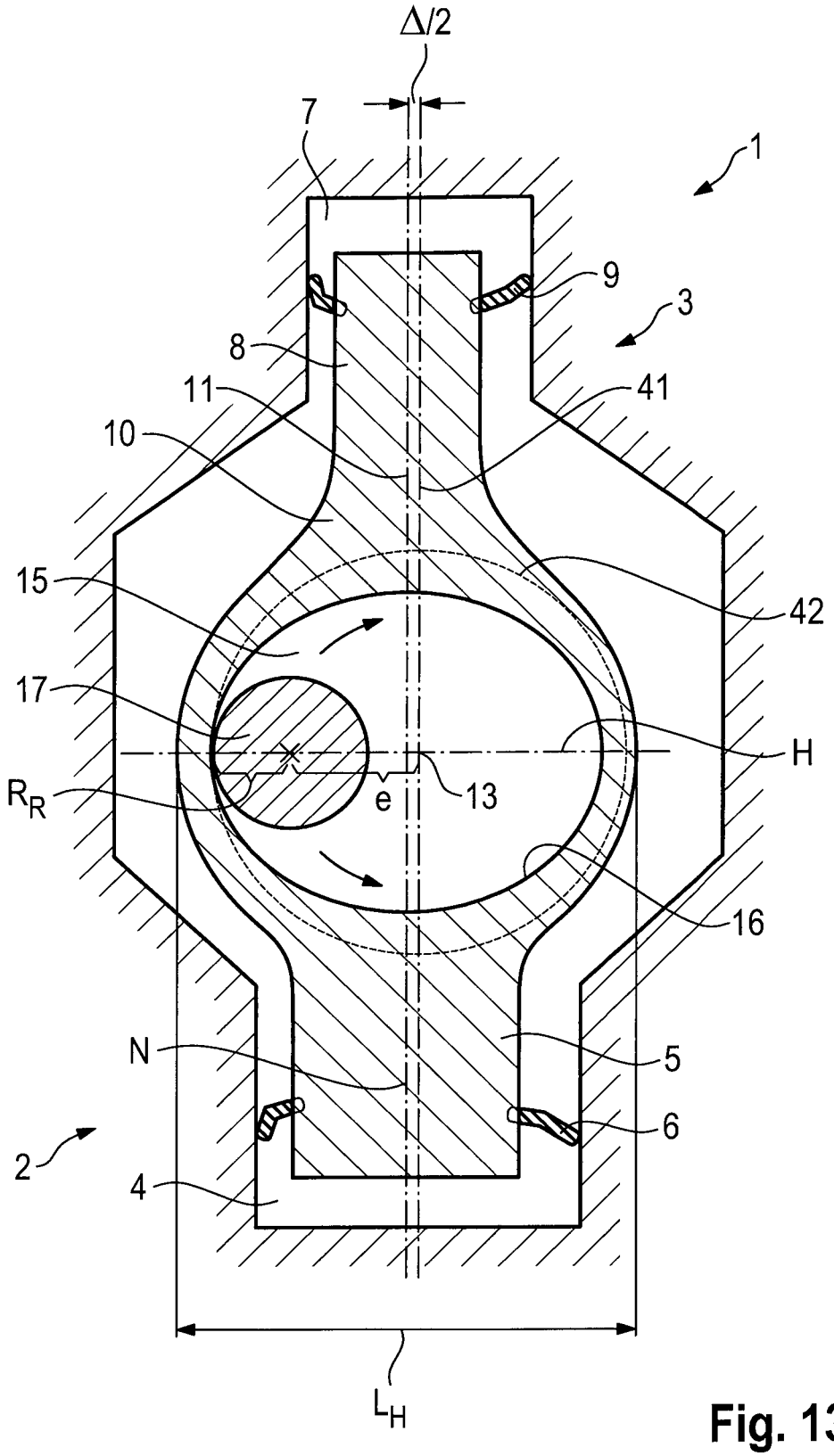
FIGS. 13*a-d* illustrate a reduced lateral distance of the slotted guide track in schematic views.
Figure 13B:
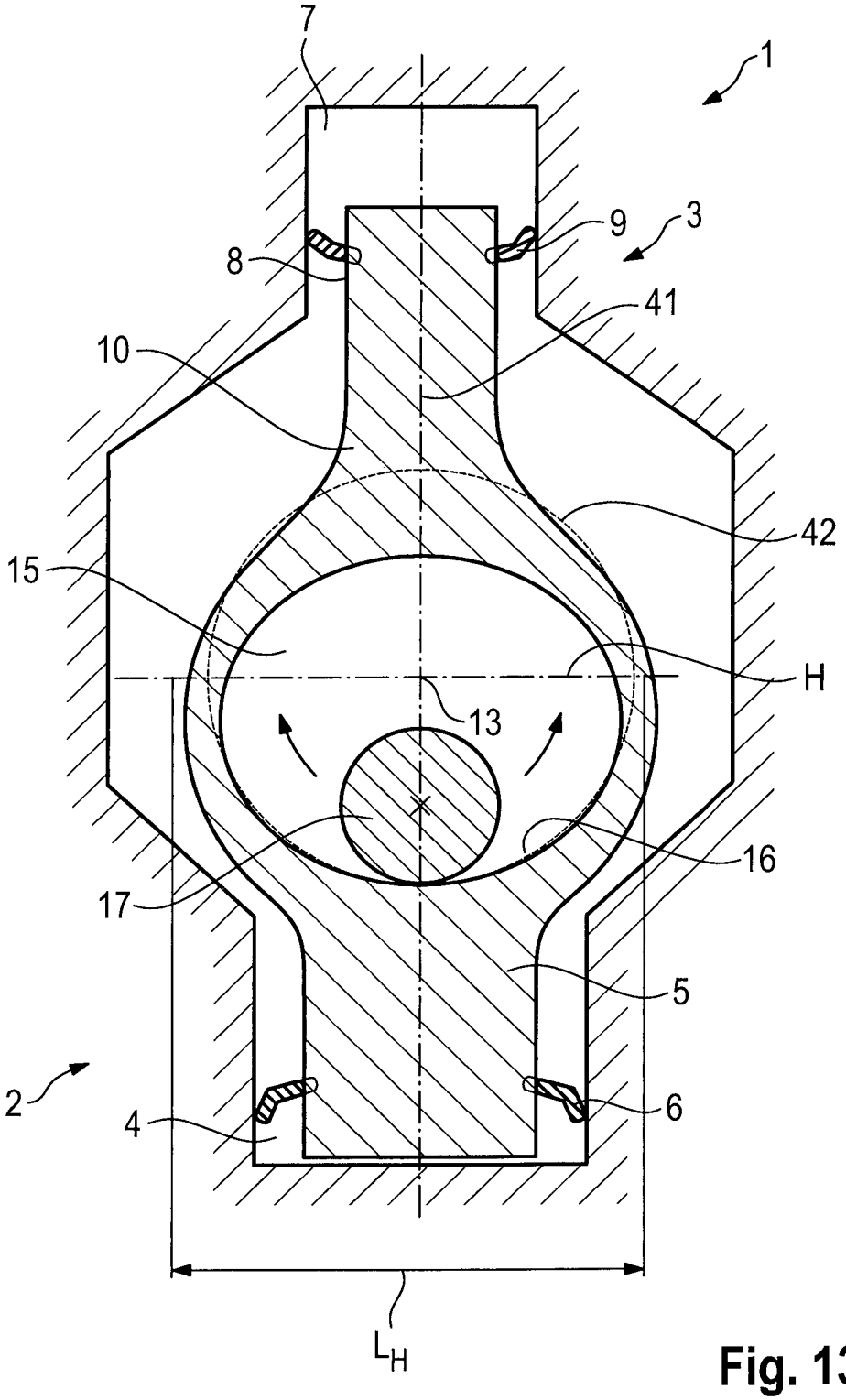
Figure 13C:
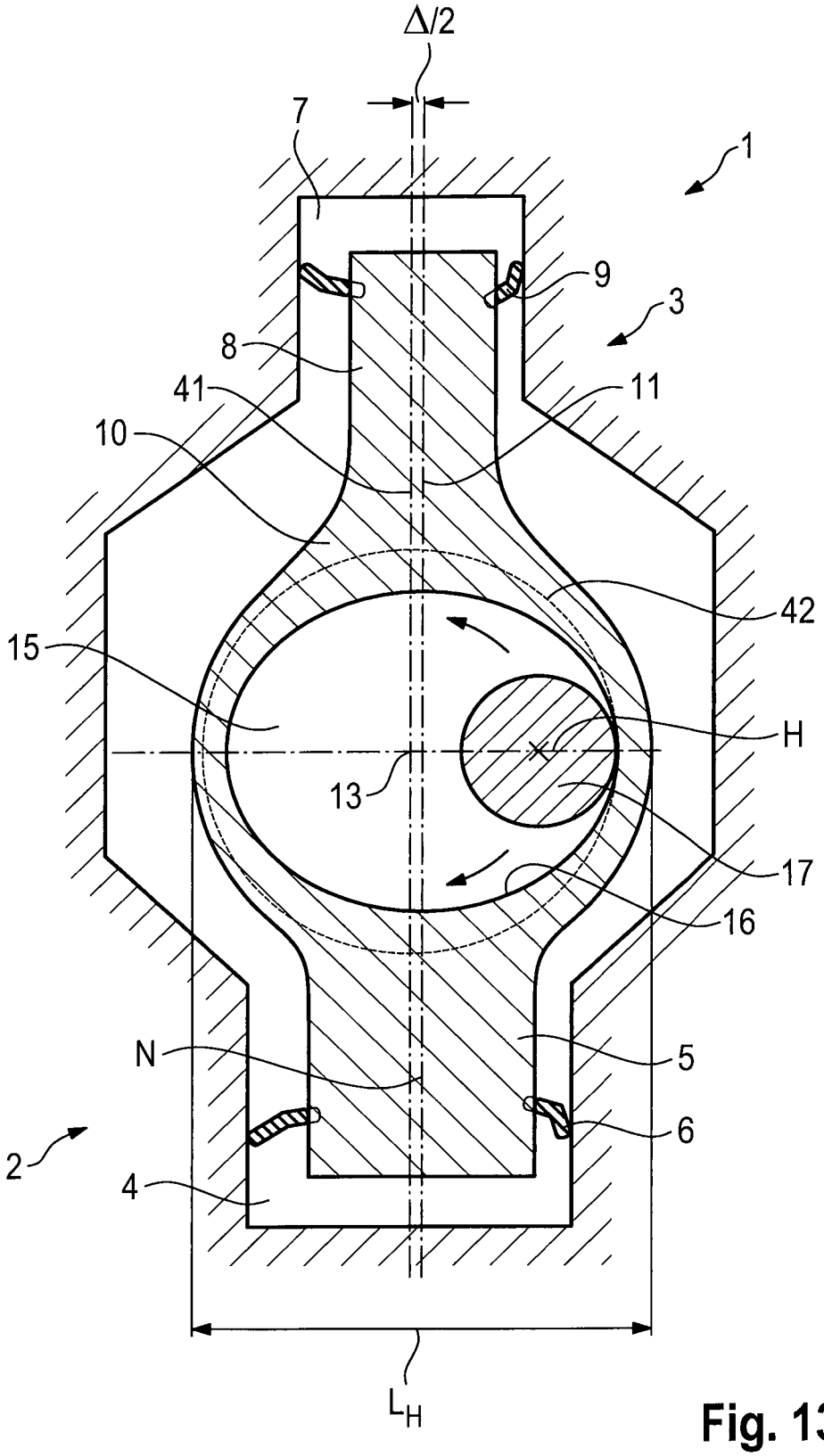
Figure 13D:
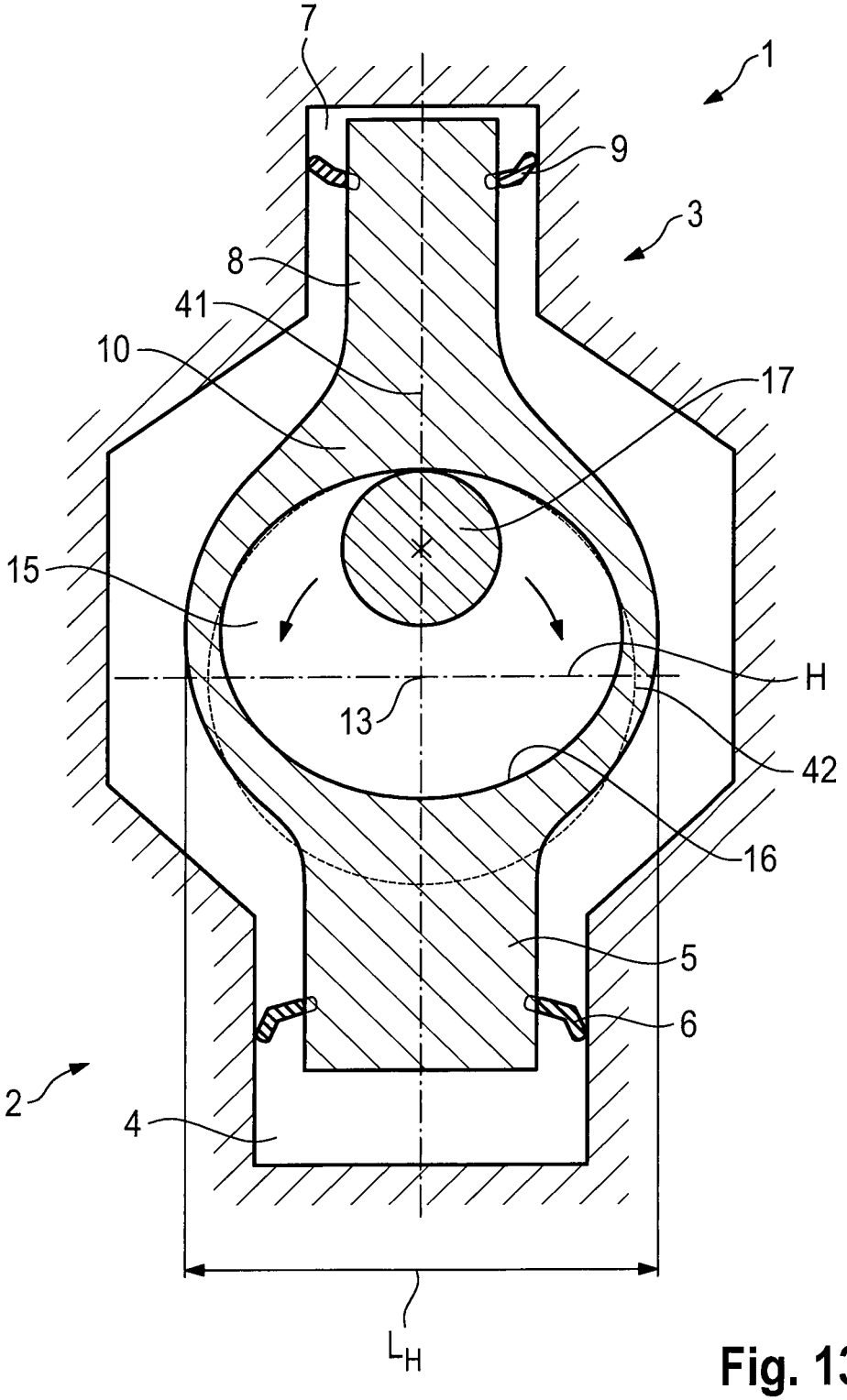

As can be seen from FIG. 13*a*, for example, the axis of rotation 13 of the drive shaft 12 (not shown in the schematic FIGS. 13*a-d*) intersects the central axis 41. When the drive shaft 12 rotates, the drive roller 17 is guided along a track and depicts an envelope circle 42. The envelope circle 42 is circular and, as can be seen from FIGS. 13*a-d*, is larger than both the main axis H and also the secondary axis N of the slotted guide track 16. In the position shown in FIG. 13*a*, in which it is rotated to an angle of 270° with respect to an upper dead center, the drive roller 17 therefore presses the piston rod 10 with respect to FIG. 13*a* to the left, so that the central axis 11 of the piston rod 10 is displaced by an amount Δ/2. Overall, the lateral distance of the slotted guide track 16, which corresponds to the length $L_H$ of the main axis H in FIG. 13*a*, is smaller by an amount Δ than twice the sum of the eccentricity e and the rolling radius $R_R$ of the drive roller 17.

The axial displacement of the piston rod 10 by the amount Δ/2 is balanced in this depiction by the sealing rings 6, 9 which are elastic. In other embodiments, such as the exemplary embodiment in FIG. 5 or FIG. 6, for example, it is likewise conceivable for the balancing of the axial displacement by the amount Δ/2 to be balanced by the spring-elastic layer 24, 24'.

Overall, this specific embodiment of the slotted guide track 16 makes it possible for the drive roller 17 to bear against the slotted guide track permanently, even when production tolerances are taken into account. It has a certain pressure with respect to the slotted guide track 16 permanently, which means that a discontinuity, in other words a lifting in the drive roller 17 from the slotted guide track 16, does not take place, even if the double-piston compressor 1 is exposed to vibrations or shaking.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1.1 Double-piston compressor, first embodiment
1.2 Double-piston compressor, second embodiment
1.3 Double-piston compressor, third embodiment
1.4 Double-piston compressor, fourth embodiment
1.5 Double-piston compressor, fifth embodiment
1.6 Double-piston compressor, sixth embodiment
1.7 Double-piston compressor, seventh embodiment
1.8 Double-piston compressor, eighth embodiment
1.9 Double-piston compressor, ninth embodiment
1.10 Double-piston compressor, tenth embodiment
1.11 Double-piston compressor, eleventh embodiment
1.12 Double-piston compressor, twelfth embodiment
2 First pressure stage, low-pressure stage
3 Second pressure stage, high-pressure stage
4 First cylinder
5 First piston
6 Sealing ring, sealing collar
7 Second cylinder
8 Second piston
9 Sealing ring, sealing collar
10 Piston rod
11 Central axis
12 Drive shaft
13 Axis of rotation
14.1-14.12 Slotted guide
15.1-15.7 Recess
16.1-16.7 Slotted guide track
17, 17', 17" Drive roller
18, 18', 18" Roller bearing
19, 19', 19" Outer ring of a roller bearing 18, 18'
20, 20' Bearing pin
21 Direction of rotation arrow, direction of rotation
22 Stroke direction arrow, stroke direction
23 Perpendicular
24, 24' Spring-elastic layer
25, 25' Drive roller
26 Bearing pin
27 Slide bearing
28 Bearing bore
29 Wall of the slotted guide track 16.5 according to FIG. 7
30, 30' Cavity
31 Wall of the slotted guide track 16.5 according to FIG. 8
32 Compression spring, bow spring
33 Inner toothing
34 External toothing
35 Inner web
36 Annular groove
37 Bearing shaft
38 Roller bearing
39 Bearing pin
40, 40.4 Surface of the recess
41 Central axis of the double-piston compressor
42 Envelope circle of the drive roller
A-F, K, L Sectional planes
e Eccentricity
H, H' Main axis
$L_H$, $L_H'$ Length of the main axis
$L_N$, $L_N'$ Length of the secondary axis
N, N' Secondary axis
$R_E$ Flanging radius
$R_R$ Rolling radius
$z_H$ Stroke height
$z_H(\varphi)$ Stroke curve
$z_{H_max}$ Stroke height
$z_{H_max}'$ Stroke height
$\Delta z_{H_max}$ Difference in stroke heights
$\alpha$ Angle of inclination
$\cos(\alpha)$ Cosine of the angle of inclination
$\varphi$ Angle of rotation
$\Delta$ Undersize amount

The invention claimed is:

1. A double-piston compressor of a compressed air supply device, comprising:

a first pressure stage and a second pressure stage, each having a cylinder with a piston guided therein in an axially movable manner, wherein the cylinder of the first pressure stage and the cylinder of the second pressure stage are arranged radially opposite one another with respect to an axis of rotation of a drive shaft, wherein the piston of the cylinder of the first pressure stage and the piston of the cylinder of the second pressure stage are rigidly connected to one another via a piston rod and are in driving connection with the drive shaft via a slotted guide;

wherein the slotted guide comprises a recess which is formed in the piston rod, provided with a slotted guide track and oriented perpendicularly to an axis of rotation of the drive shaft with its cross-sectional plane, wherein the slotted guide comprises a drive roller which is engaged with the recess and fastened to the drive shaft in an axially parallel, eccentric, and also rotatable manner with respect to the axis of rotation of the drive shaft, wherein the recess in the slotted guide is delimited by a closed slotted guide track which is oriented centrally with respect to a central axis of the piston rod and on which the drive roller rolls and is permanently loaded by a resulting contact force on the two pistons, wherein a lateral distance of the slotted guide track, measured perpendicularly to the central axis of the piston rod, corresponds at most to a sum of twice an eccentricity and twice a rolling radius of the drive roller, and wherein a stroke distance of the slotted guide track, measured parallel to the central axis of the piston rod, exceeds twice the rolling radius of the drive roller and falls below the sum of twice the eccentricity and twice the rolling radius of the drive roller.

2. The double-piston compressor as claimed in claim 1, wherein the lateral distance of the slotted guide track is smaller by a delta amount than the sum of twice the eccentricity and twice the rolling radius of the drive roller.

3. The double-piston compressor as claimed in claim 2, wherein the delta amount is within a range of 1% to 10% of the sum of twice the eccentricity and twice the rolling radius of the drive roller.

4. The double-piston compressor as claimed in claim 1, wherein the recess of the slotted guide is delimited by an elliptical slotted guide track, wherein a main axis whereof has a length which is at most the sum of twice the eccentricity and twice the rolling radius of the drive roller divided by a cosine of an angle of inclination of the main axis with respect to a perpendicular to the central axis of the piston rod, and wherein a secondary axis whereof has a length that falls below the sum of twice the eccentricity and twice the rolling radius of the drive roller, but which is at least large enough for the flanging radii of the elliptical slotted guide track to be greater than the rolling radius of the drive roller.

5. The double-piston compressor as claimed in claim 4, wherein the main axis of the elliptical slotted guide track of the slotted guide is oriented perpendicularly to the central axis of the piston rod.

6. The double-piston compressor as claimed in claim 4, wherein the main axis of the elliptical slotted guide track of the slotted guide is inclined with respect to a perpendicular to the central axis of the piston rod in the direction of rotation of the drive shaft.

7. The double-piston compressor as claimed in claim 6, wherein the angle of inclination of the main axis of the ellipical slotted guide track is at most 45° with respect to a perpendicular to the central axis of the piston rod.

8. The double-piston compressor as claimed in claim 4, wherein the main axis of the elliptical slotted guide track of the slotted guide is inclined with respect to a perpendicular to the central axis of the piston rod against the direction of rotation of the drive shaft.

9. The double-piston compressor as claimed in claim 4, wherein the elliptical slotted guide track of the slotted guide is symmetrically configured with semi-axes of the secondary axis of a same length.

10. The double-piston compressor as claimed in claim 4, wherein the elliptical slotted guide track of the slotted guide is asymmetrically configured with semi-axes of the secondary axis of different lengths.

11. The double-piston compressor as claimed in claim 4, wherein the main axis of the elliptical slotted guide track has a length which falls slightly below the sum of twice the eccentricity and twice the rolling radius of the drive roller divided by the cosine of the angle of inclination of the main axis with respect to a perpendicular to the central axis of the piston rod.

12. The double-piston compressor as claimed in claim 1, wherein the two pistons are each guided in the cylinders via a sealing ring.

13. The double-piston compressor as claimed in claim 12, wherein the sealing rings allow a movement of the pistons perpendicularly to the central axis.

14. The double-piston compressor as claimed in claim 1, wherein the radially inner face of the recess is lined with a spring-elastic layer which forms the slotted guide track of the slotted guide.

15. The double-piston compressor as claimed in claim 14, wherein the spring-elastic layer of the slotted guide track of the slotted guide is made of rubber.

16. The double-piston compressor as claimed in claim 1, wherein the outer wall of the drive roller is lined with a spring-elastic layer.

17. The double-piston compressor as claimed in claim 16, wherein the spring-elastic layer of the outer wall of the drive roller is made of rubber.

18. The double-piston compressor as claimed in claim 1, wherein at least one central portion of the slotted guide track of the slotted guide is designed to be capable of buckling automatically in a load-dependent manner.

19. The double-piston compressor as claimed in claim 18, wherein a wall of the at least one central portion of the slotted guide track is of spring-elastic design and spans a cavity in the piston rod.

20. The double-piston compressor as claimed in claim 18, wherein a wall of the at least one central portion of the slotted guide track has a bending-elastic design and spans a cavity in the piston rod, in which at least one compression spring is arranged which is in contact with the wall.

21. The double-piston compressor as claimed in claim 1, wherein the slotted guide track of the slotted guide is of planar design in the longitudinal profile, and wherein the drive roller has a cylindrical outer wall with which the drive roller rolls on the slotted guide track.

22. The double-piston compressor as claimed in claim 21, wherein the slotted guide track of the slotted guide is provided with a circumferential inner web and wherein the drive roller has in its outer wall a circumferential annular groove with which the inner web of the slotted guide track engages for the axial guiding of the drive roller.

23. The double-piston compressor as claimed in claim 1, wherein the slotted guide track of the slotted guide is provided with circumferential inner toothing and wherein the drive roller has on its outer wall outer toothing with a same tooth pitch, via the pitch circle whereof the drive roller rolls on the pitch circle of the inner toothing of the slotted guide track.

24. The double-piston compressor as claimed in claim 1, wherein the drive roller is mounted rotatably via a rolling bearing or a slide bearing on a bearing bolt which is fastened eccentrically to the drive shaft.

25. The double-piston compressor as claimed in claim 24, wherein the drive roller is formed by an outer ring of the rolling bearing or by a bushing of the slide bearing.

26. The double-piston compressor as claimed in claim 24, wherein the bearing bolt of the drive roller or the drive roller itself is provided with a central outer bearing shaft which is radially externally supported via a rolling bearing or a slide bearing on a bearing pin oriented coaxially to the axis of rotation of the drive shaft and fastened at a housing end.

27. The double-piston compressor as claimed in claim 1, wherein the drive roller is configured as a cylindrical plate and rigidly connected to a central bearing bolt which is rotatably mounted via a rolling bearing or a slide bearing in a bearing bore arranged eccentrically on the drive shaft.

* * * * *